US011465872B2

(12) United States Patent
Theofilos et al.

(10) Patent No.: US 11,465,872 B2
(45) Date of Patent: Oct. 11, 2022

(54) TAPE DISPENSER

(71) Applicant: SNJ Patents, LLC, Palm Beach Gardens, FL (US)

(72) Inventors: Charles Theofilos, Palm Beach Gardens, FL (US); Stefan Theofilos, Palm Beach Gardens, FL (US); Krutik Shah, London (GB)

(73) Assignee: SNJ Patents, LLC, Palm Beach Gardens, FL (US)

( * ) Notice: Subject to any disclaimer, the term of this patent is extended or adjusted under 35 U.S.C. 154(b) by 246 days.

(21) Appl. No.: 16/912,230

(22) Filed: Jun. 25, 2020

(65) Prior Publication Data

US 2021/0403271 A1 Dec. 30, 2021

(51) Int. Cl.
*B65H 35/00* (2006.01)

(52) U.S. Cl.
CPC ..... *B65H 35/0033* (2013.01); *B65H 35/0086* (2013.01); *B65H 2701/377* (2013.01)

(58) Field of Classification Search
None
See application file for complete search history.

(56) References Cited

U.S. PATENT DOCUMENTS 1,892,544 A 12/1932 Wanders
2,064,886 A * 12/1936 Charlesworth ..... B65H 49/30 242/577.4
2,267,071 A * 12/1941 Becker ..... B65H 49/30 242/127
2,426,984 A * 9/1947 Craig ..... B65H 75/38 242/407.1
2,446,583 A * 8/1948 Gopner ..... A01K 97/16 242/397.3
2,734,575 A 2/1956 Gilbreth et al.
2,798,552 A 7/1957 Aldrich
2,805,828 A * 9/1957 Bachman ..... B65H 75/24 242/537
3,149,764 A 9/1964 Waltz
3,176,892 A 4/1965 Waltz
3,467,332 A * 9/1969 Bachman ..... B32B 17/10981 242/537
4,088,276 A 5/1978 Littleton
4,884,734 A 12/1989 Kahl, Jr. et al.
(Continued)

FOREIGN PATENT DOCUMENTS

EP 0053312 6/1982
EP 1885639 2/2008

*Primary Examiner* — William A. Rivera
(74) *Attorney, Agent, or Firm* — Stephen Y. Liu; Carstens & Cahoon, LLP

(57) ABSTRACT

A device for dispensing rolled items, such as tape. The hand-held or mounted tape dispensing device is designed to accommodate variously sized or shaped rolls of tape. The tape dispensing device for dispensing a tape may comprise a support structure and one or more tape holder sliders configured to be moveable from a first position to at least one second position. The tape dispensing device may also include one or more tape holder sliders, which may move simultaneously in a single direction. The tape dispensing device may also include a tape dispenser blade having a cutting edge and configured to be moveable from a first position to at least one second position and to rotate to a position along the cutting edge at different angles.

17 Claims, 29 Drawing Sheets

(56) References Cited

U.S. PATENT DOCUMENTS

| | | | | |
|---|---|---|---|---|
| 5,739,342 | A | 6/1998 | Luhman et al. | |
| 8,191,597 | B2 | 6/2012 | Vulpitta | |
| 8,443,862 | B1 * | 5/2013 | Manabat | B65H 35/0026 156/574 |
| 8,839,838 | B2 * | 9/2014 | Parkhe | B65H 35/0013 225/56 |

* cited by examiner

TAPE DISPENSER

FIELD OF THE INVENTION

The present invention relates to devices for dispensing rolled items, such as tape; more particularly, to hand-held or mounted tape dispensing units designed to accommodate variously sized rolls of tape.

BACKGROUND OF THE INVENTION

Adhesive material, such as tape, is a widely-used item designed to hold or fasten something. Whether a simple transparent adhesive tape for securing wrapping paper to a gift, such as SCOTCH tape, or a more durable tape, such as a cloth or scrim backed pressure sensitive tape, often with a coating of polyethylene, or duct tape, due to the nature of the material, manipulation of such material can present difficulties. One difficulty results from the material binding to itself, making it difficult to use. Moreover, when multiple pieces of the material are required, finding the edge of the tape and removing the edge from the roll can also be problematic.

Tape holders have been developed to address these issues. Typical holders hold the tape roll in place, with at least a portion of the tape roll extended from the roll. Examples of such tape dispensers can be found in U.S. Pat. Nos. 8,191,597, 5,759,342, or 4,884,734. Typical tape dispensers utilize a fixed portion designed to engage with the center portion of the tape roll and a fixed cutting member for cutting the tape. Most tape dispensers are designed to handle fixed sized tape rolls, as they utilize fixed components that engage with the inner diameter of the tape roll. As such, a user must use one tape roll disperser for large diameter tape rolls and another tape roll disperser for smaller diameter tape rolls.

A tape dispenser that can be easily manipulated to accommodate variously sized rolls of tape would be beneficial.

SUMMARY OF THE INVENTION

The present invention is directed towards devices for dispensing rolled items, such as tape. The present invention includes hand-held or mounted tape dispensing units designed to accommodate variously sized or shaped rolls of tape, or other rolled materials. The tape dispenser may be designed as a hand-held unit or may be mountable. The tape dispensing device for dispensing a tape may comprise a support structure and one or more first tape holder sliders, such as a first tape holder slider configured to be moveable from a first position to at least one second position, a second tape holder slider configured to be moveable from a first position to at least one second position, and a third tape holder slider configured to be moveable from a first position to at least one second position. The tape dispensing device may also include an actuator operatively connected to the first tape holder slider, the second tape holder slider, and the third tape holder slider, wherein activation of the actuator moves the first, second, and third tape holder sliders simultaneously in a single direction. The tape dispensing device may also include a tape disperser blade having a cutting edge, and configured to be moveable from a first position to at least one second position and to rotate to position the cutting edge at different angles.

Accordingly, it is an objective of the invention to provide an improved device for dispensing rolled items, such as tape.

It is a further objective of the invention to provide an improved tape dispenser.

It is yet another objective of the invention to provide a tape dispenser that can be manipulated to accommodate variously sized rolls of tape.

It is a still further objective of the invention to provide a tape dispenser that can be manipulated to accommodate variously sized rolls of tape which utilizes an actuating mechanism.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
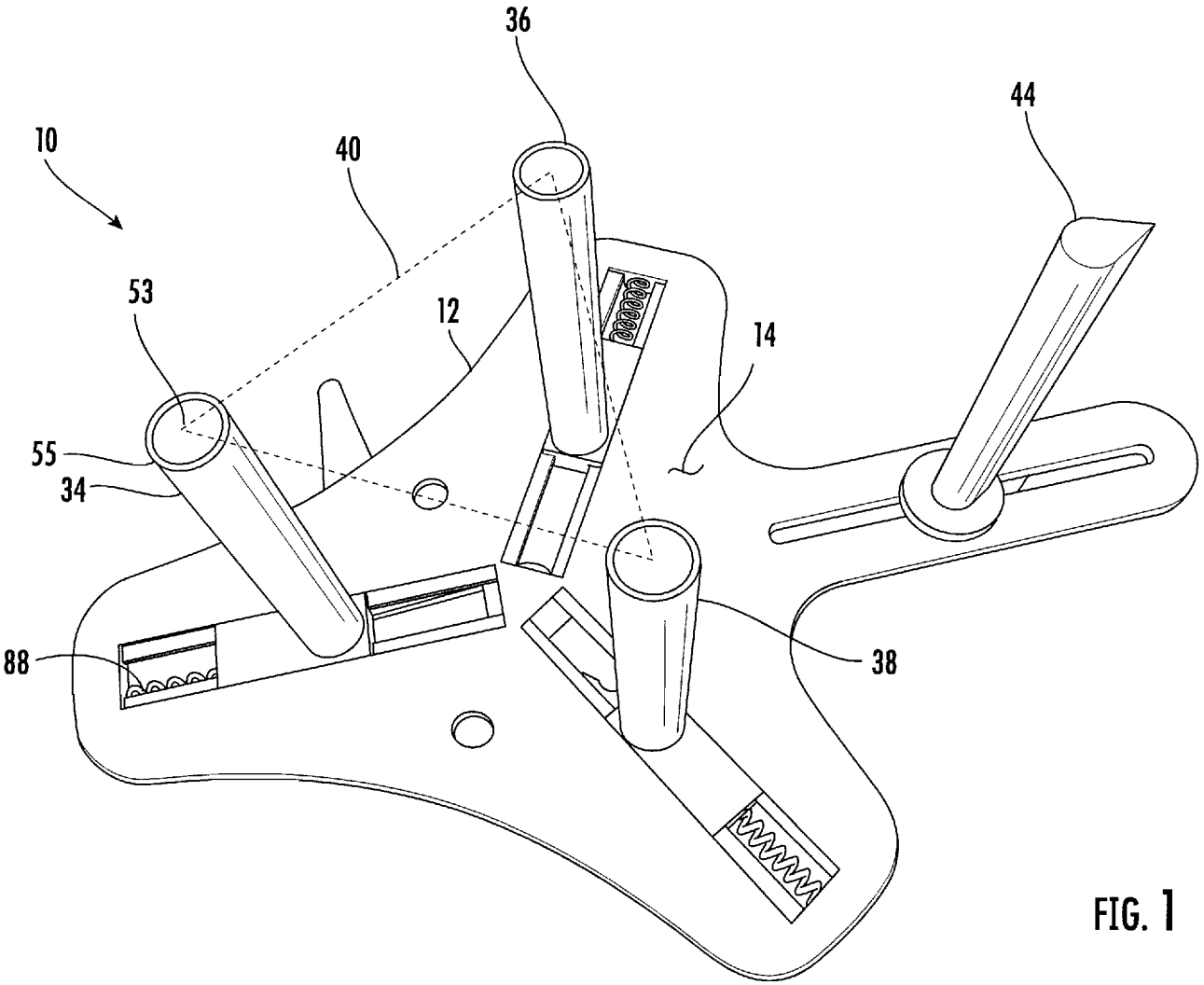
FIG. 1 is a perspective view of an illustrative embodiment of a tape dispenser, showing a first upper surface.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1 and 2, an illustrative embodiment of a device for dispensing a rolled item is shown. As described herein, the rolled item is tape. Accordingly, the device for dispensing a rolled item will be referred to generally as a tape dispenser 10. While the preferred embodiment describes the use with rolled tape, other rolled items may be applicable, such as aluminum foil, shrink wrap, saran wrap/food plastic wrap/cling film, double sided tape, or any material on a roll that may bind to itself. The tape dispenser 10 comprises a support structure 12 having a first surface 14 (FIG. 1) and second, opposing or opposite surface (FIG. 2). The tape dispenser 10 is configured to receive a tape roll of different sizes, allowing a user to remove individually sized portions of the tape. Given the wide disparity between sizes of tape rolls, such as the relatively small size of SCOTCH tape (pressure sensitive tape) rolls when compared to a roll of shipping or packaging tape, the tape dispenser 10 is designed to accommodate and hold either one, and any sized or diameter roll, larger, smaller, or in between, smaller, or larger.

Figure 3:
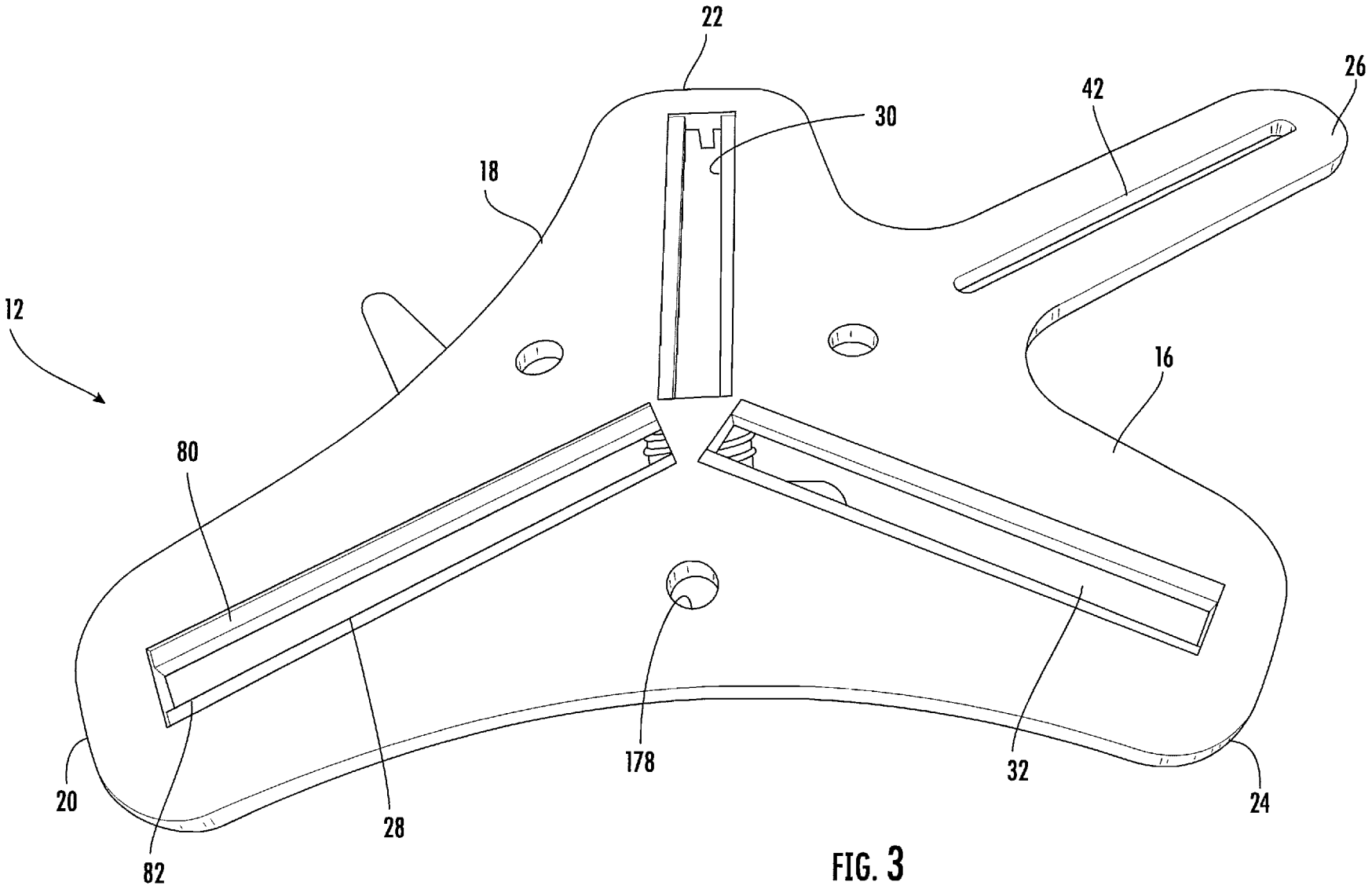
FIG. 3 is a perspective view of the tape dispenser support structure.

FIG. 3 illustrates the support structure 12 with several functional components removed. The support structure 12 may be defined by a main body 16 having a first end 20, two side ends 22 and 24, and a second end 26 opposing the first end 20. The second opposing end 26 may be configured to have a different profile, such as a smaller size or width as compared to the first end 20, or the two side ends 22 and 24. The first end 20 and two side ends 22 and 24 may be orientated to provide a tripod like shape or configuration.

Figure 5A:
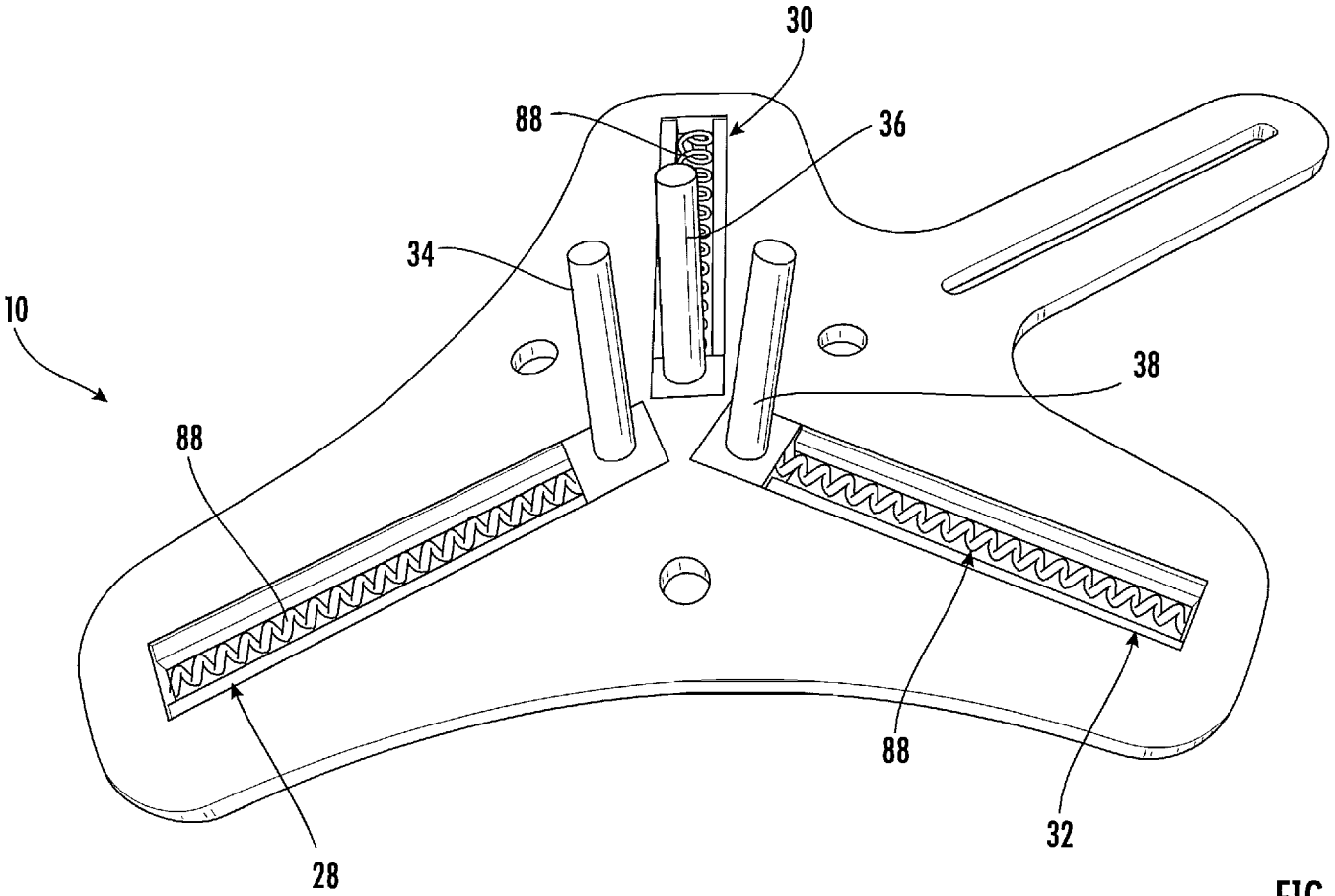
FIG. 5A illustrates the tape dispenser with the first tape holder slider, the second tape holder slider, and the third tape holder slider positioned inwardly, towards the center.

One or more, preferably a plurality of open slots, referred to as slider channel slots 28, 30, and 32 are cut or formed into the support structure 12. Each of the slider channel slots 28, 30, and 32 may extend from a portion at or near the center of the support structure 12, towards the first end 20 or two side ends 22 and 24. Slider channel slot 28 is sized and shaped to operatively interact with and hold a first tape holder slider 34 (see FIGS. 1, 5A). Slider channel slots 30 is sized and shaped to operatively interact with and hold a second tape holder slider 36. Slider channel slots 32 is sized and shaped to operatively interact with and hold a third tape holder slider 38. The slider channel slots 28, 30, and 32 may be orientated on the support structure 12 at angles, such as forming or having a Y-shape configuration, relative to each other so that when the first tape holder slider 34, the second tape holder slider 36, and the third tape holder slider 38 are placed within the slider channel slots 28, 30, and 32, the sliders 34, 36, and 38 are orientated to form a triangular plane (FIG. 1). While three tape holders are illustrated, the tape dispenser 10 may include at least two tape holders or more than three tape holders.

The support structure 12 may also contain an additional open slot, referred to as a blade channel slot 42. The blade channel slot 42 may be cut or formed into the support structure 12, and associated with the second opposing end 26. The blade channel slot 42 may extend from a portion at or near the second opposing end 26, and extend in the direction towards the center of the support structure 12. The blade channel slot 42 is sized and shaped to operatively interact with and hold a tape dispenser blade 44 (See FIG. 1).

Figure 5B:
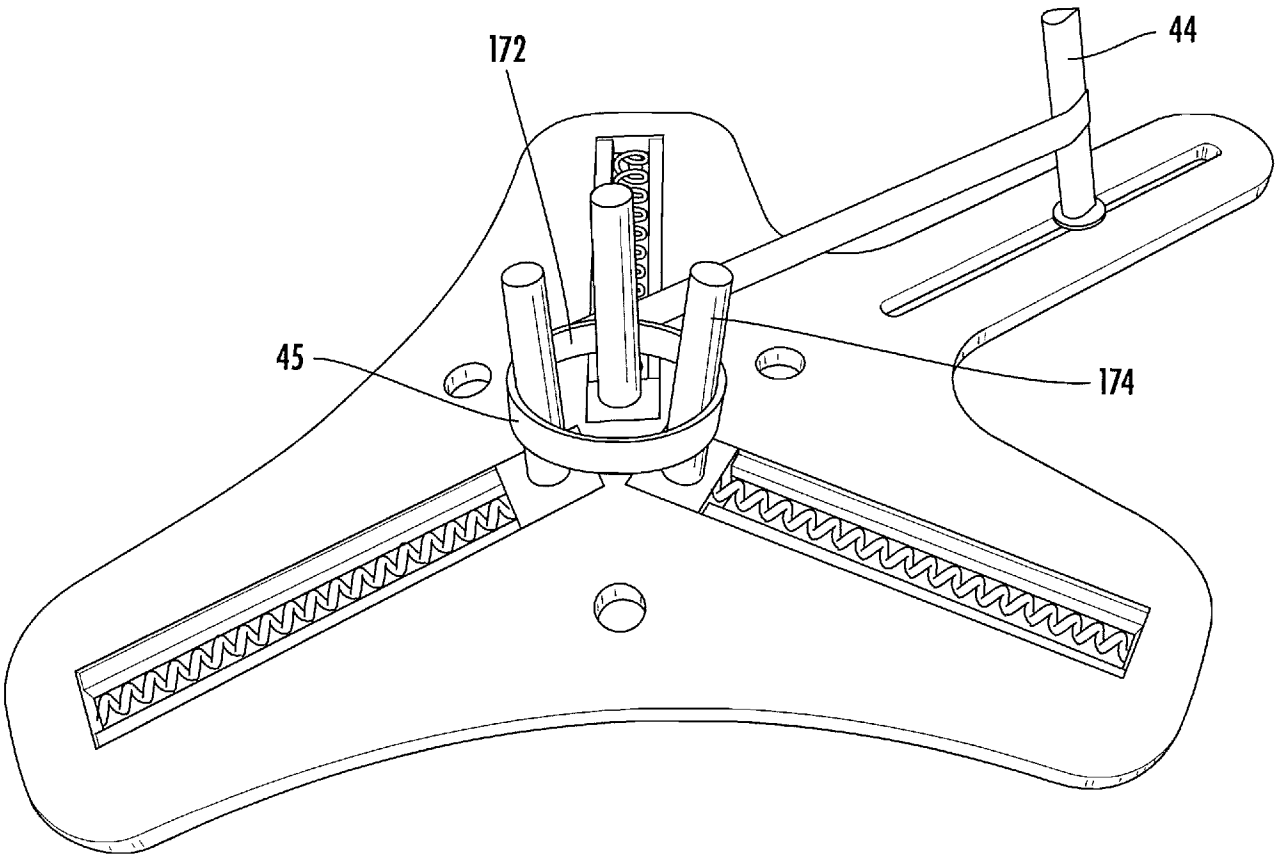
FIG. 5B shows the tape dispenser illustrated in FIG. 5A with a roll of tape.
Figure 6A:
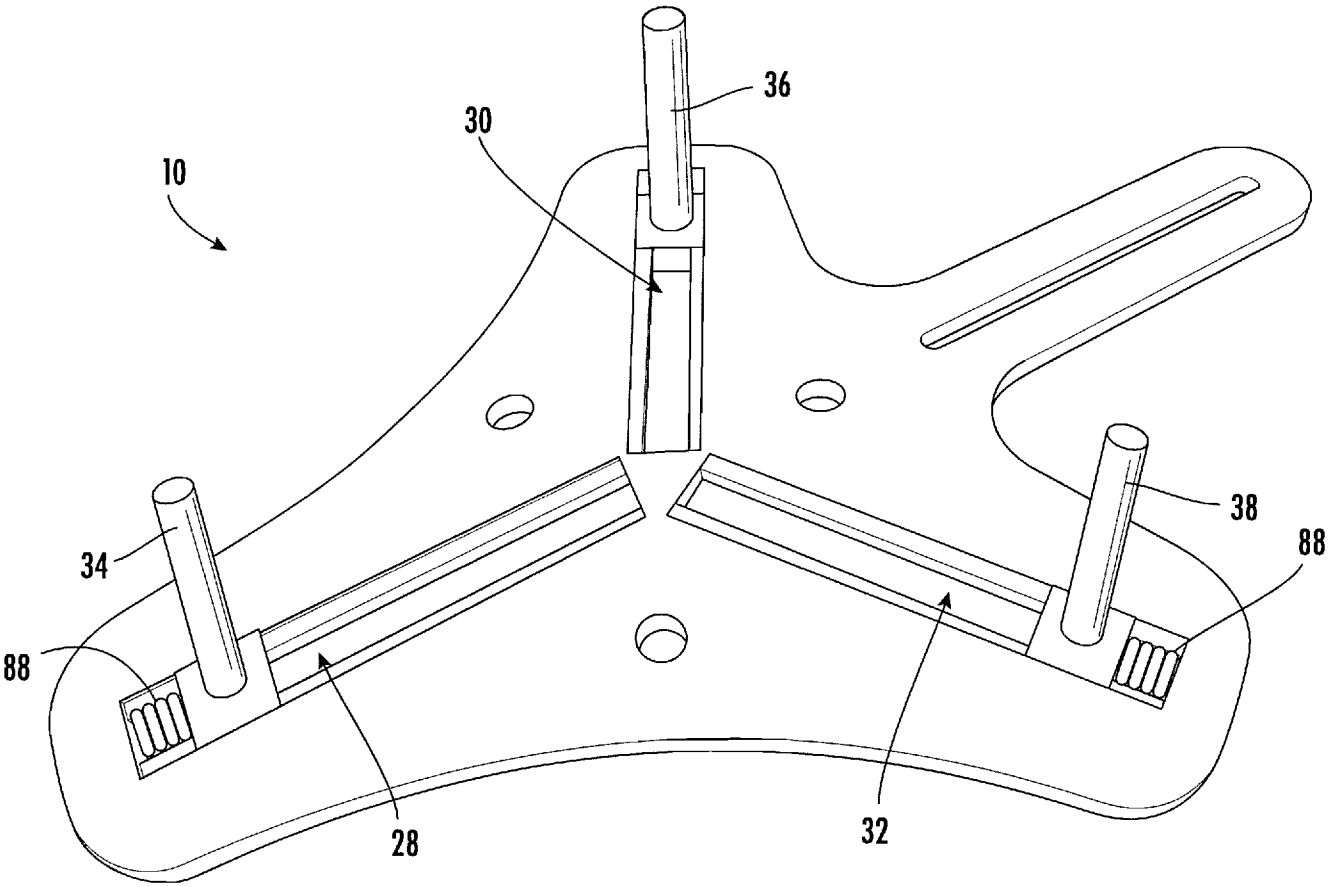
FIG. 6A illustrates the tape dispenser with the first tape holder slider, the second tape holder slider, and the third tape holder slider positioned outwardly, away from the center.
Figure 6B:
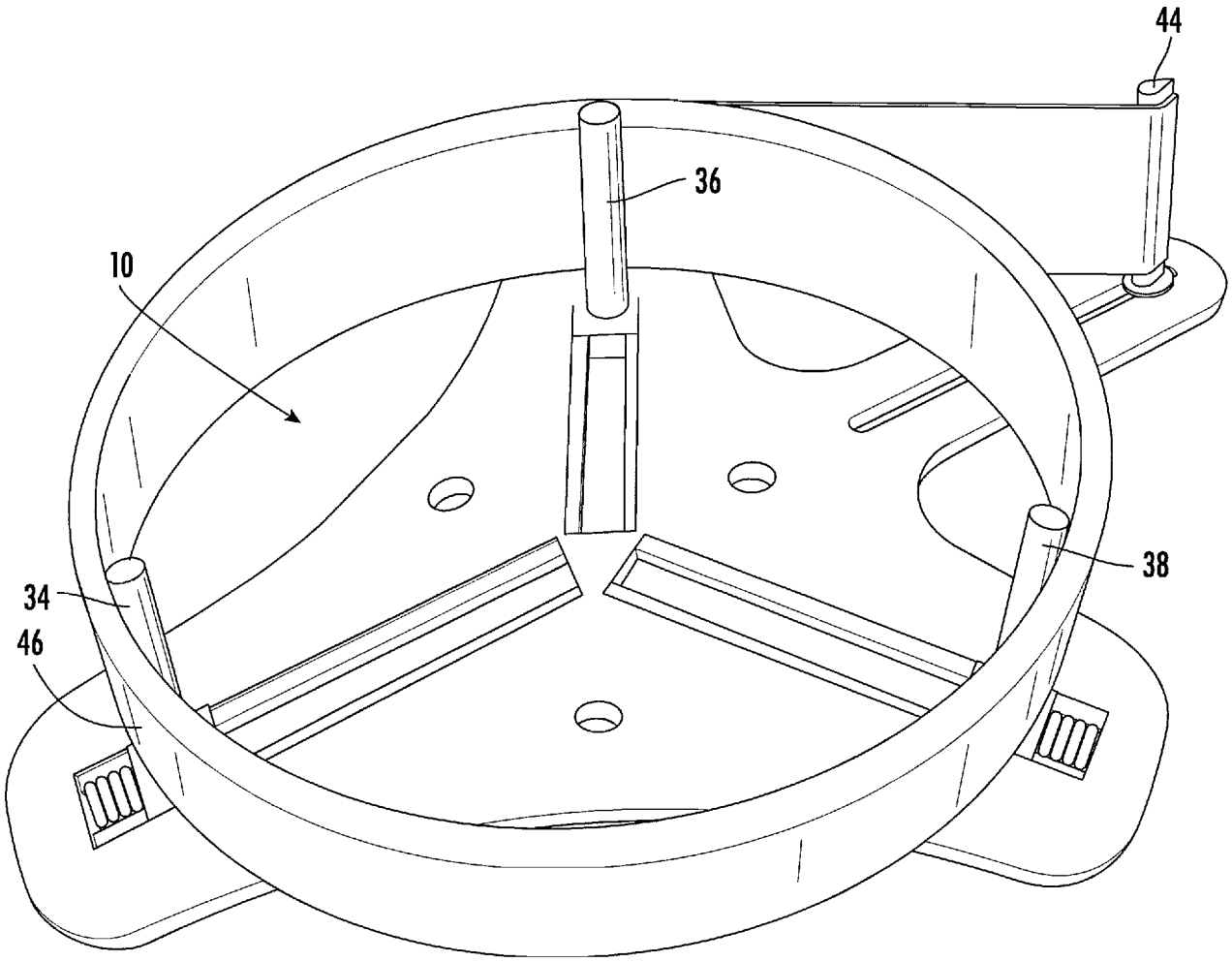
FIG. 6B shows the tape dispenser illustrated in FIG. 6A with a roll of tape secured.
Figure 7:
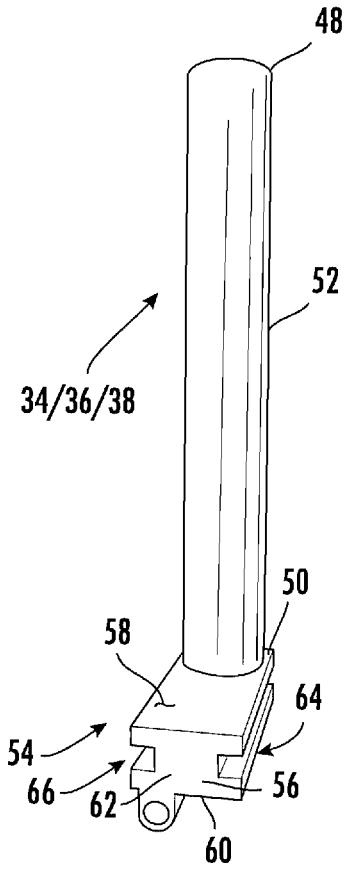
FIG. 7 is a perspective view of an illustrative example of a tape holder slider.
Figure 8:
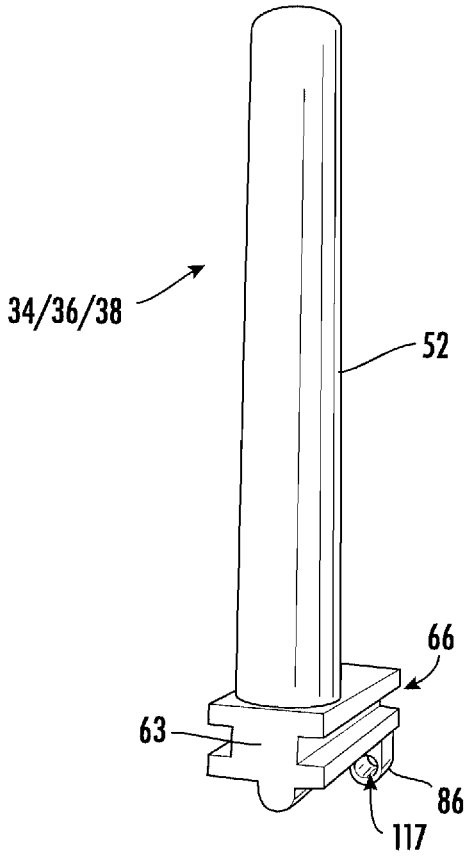
FIG. 8 is an alternative view of the tape holder slider.

Unlike many of the traditional tape dispensers, the tape dispenser 10 is designed to accommodate different sized and shaped tape rolls. That is, the tape dispenser 10 is designed to accommodate a roll of tape with a small, medium, or large diameter, different sizes, and different tape widths. To accommodate such diversity in tape roll diameter, sizes, and tape width, the first tape holder slider 34, the second tape holder slider 36, and the third tape holder slider 38 are designed to slide, or move, in a linear direction within their respective slots, slider channel slots 28, 30, and 32. Accordingly, moving the first tape holder slider 34, the second tape holder slider 36, and the third tape holder slider 38 inwardly, towards the center, see FIGS. 5A and 5B, allows for accommodating a smaller diameter tape roll 45. Moving the first tape holder slider 34, the second tape holder slider 36, and the third tape holder slider 38 outwardly, away from the center, see FIGS. 6A and 6B, allows for accommodating a larger diameter tape roll 46.

Referring to FIGS. 7-10, an illustrative embodiment of the tape holder slider is shown. The embodiment illustrated is the first tape holder slider 34. The second tape holder slider 36 and the third tape holder slider 38 each have the same features and structures. As such, tape holder slider features and structures will only be described for the first tape holder slider 34. However, such features and structures are applicable to the second tape holder slider 36 and the third tape holder slider 38. The first tape holder slider 34 (or second tape holder slider 36 or third tape holder slider 38) comprises a first upper end 48, a second opposing lower end 50, and a main body 52 separating the first upper end 48 and the second opposing lower end 50 and defining a height. The first tape holder slider main body 52 is shown having a generally cylindrical shape. Such shape however, is illustrative only and other shapes may be used. The first tape holder slider 34 may be designed having a solid inner core 53 surrounded by an outer sleeve 55, see FIG. 1. The outer sleeve 55 may be made of a plastic material that spins relative to the solid inner core 53 as the tape roll, mounted to the tape dispenser 10, spins to provide sufficient rolling resistance.

Figure 9:
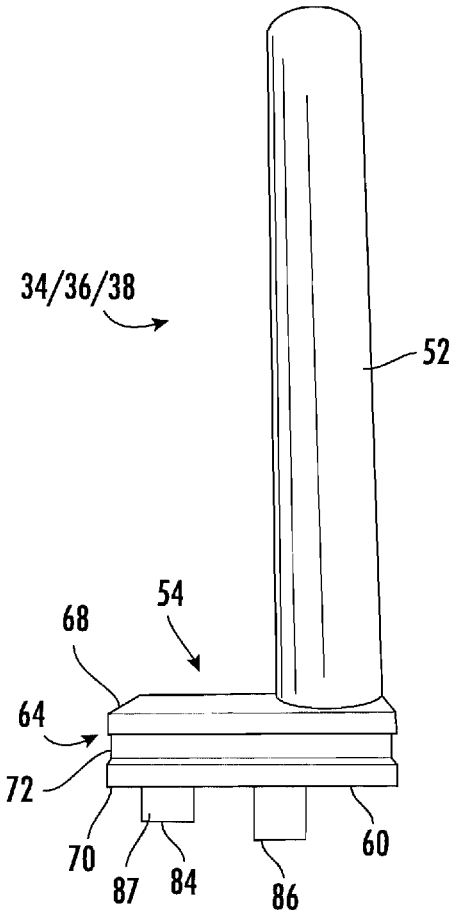
FIG. 9 is a left-side view of the tape holder slider.
Figure 10:
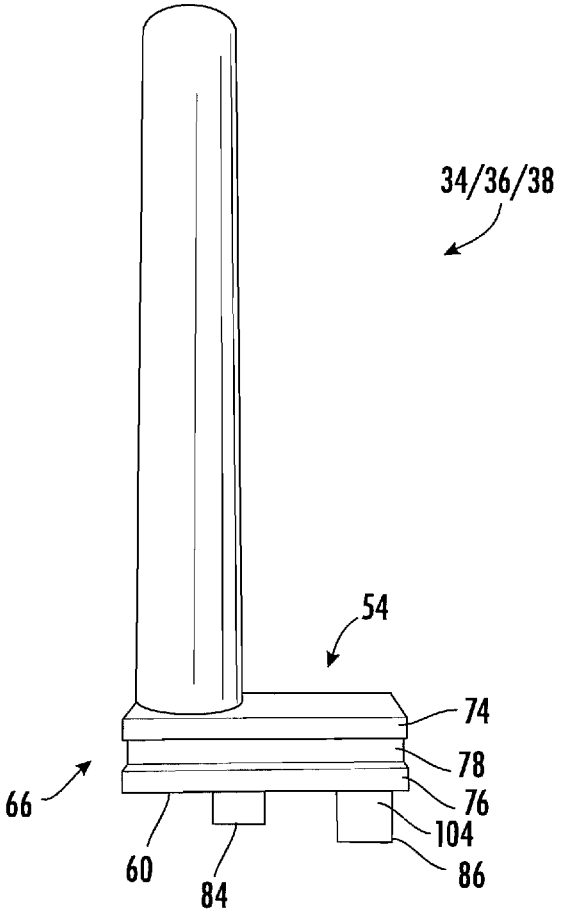
FIG. 10 is a right-side view of the tape holder slider.

Formed or attached to the second opposing lower end 50 is a slider channel slot coupling member 54. The slider channel slot coupling member 54 is configured to secure to slider channel slots in order to movably secure the first tape holder slider 34 within a slider channel slot, such as the slider channel slot 28. The slider channel slot coupling member 54 comprises a main body slider plate 56 which comprises an upper surface 58, a lower surface 60, a front surface 62, and a back surface 63. The main body slider plate 56 is designed to maintain the first tape holder slider 34, the second tape holder slider 36, and the third tape holder slider 38 perpendicular to the support structure 12. The slider channel slots coupling member main body may comprise two cut out sections, left channel 64 and right channel 66. The left channel 64, see FIG. 9, is defined by a left top overhang 68, a left bottom overhang 70, and a left back wall 72 separating the left top overhang 68 and the left bottom overhang 70, thus defining the height of the left channel 64. Preferably, the left channel 64 spans the entire length of the slider channel slot coupling main body 56 (from the front surface 62 to the back surface 63). The right channel 66, see FIG. 10, is defined by a right top overhang 74, a right bottom overhang 76, and a right back wall 78 separating the right top overhang 74 and the right bottom overhang 76, thus defining the height of the right channel 66. Preferably, the right channel 66 spans the entire length of the slider channel slot coupling main body 56 (from the front surface 62 to the back surface 63).

The slider channel slot coupling member 54 is designed to slidably move in a forward and backward linear direction within the slider channel slot 28. To aid in proper and smooth forward or backward movement, the left channel 64 is designed to engage with a left slider channel slot guide member 80 and the right channel 66 is designed to engage with a right slider channel slot guide member 82. Referring back to FIG. 3, the slider channel slot 28 is shown with a recessed portion forming the left slider channel slot guide member 80 and the right slider channel slot guide member 82. The height of the left channel 64 and the right channel 66 is a sufficient size to accommodate and maintain therein the left slider channel slot guide member 80 and the right slider channel slot guide member 82 as they or are maintained in a stationary position.

Figure 4:
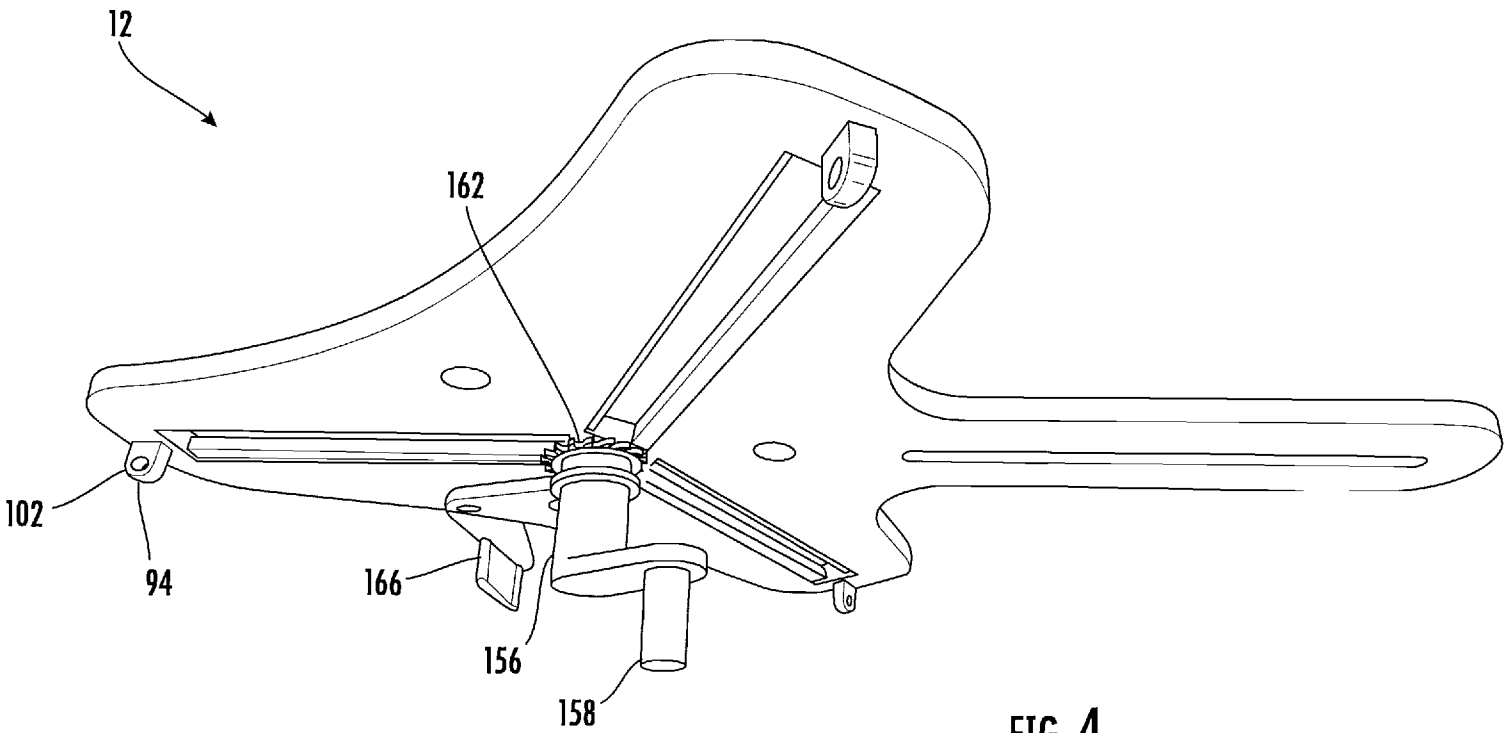
FIG. 4 is an alternative perspective view of the tape dispenser support structure.
Figure 11:
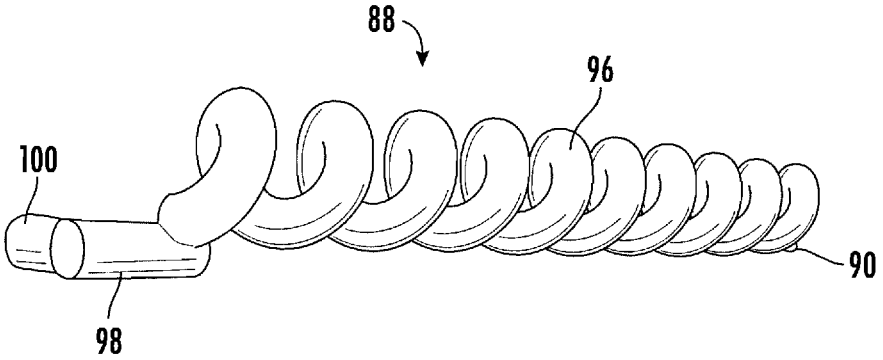
FIG. 11 is an illustrative embodiment of a compression member, shown as a spring.
Figure 12:
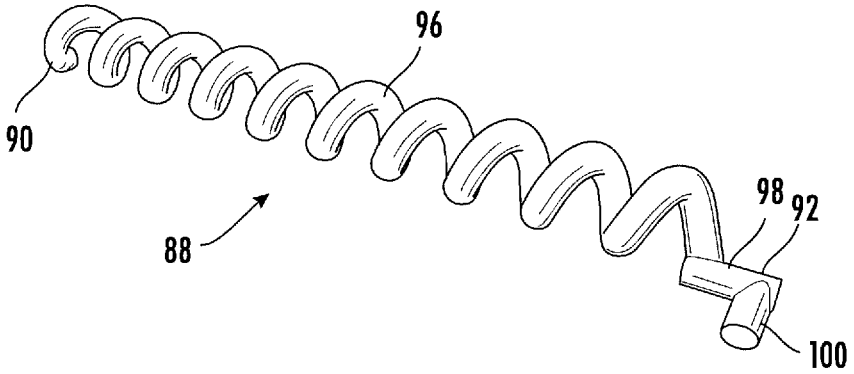
FIG. 12 is an alternative view of the spring.

The slider channel slot coupling member lower surface may contain one or more securing brackets configured to receive and hold therein one or more structures. As illustrated in the figures, the slider channel slot coupling member lower surface 60 comprises two securing brackets, a first compression unit securing bracket 84 and a second actuator structure securing bracket 86. The first compression unit securing bracket 84 comprises a main body 87 having open ends sized and shaped to receive and secure therein a first end of a compression device, such as a spring 88 Referring to FIGS. 11 and 12, an illustrative example of the spring 88 is shown. The spring 88 has a first end 90, which is configured to secure to the first compression unit securing bracket 84, a second end 92, configured to secure to a support structure bracket 94 (see FIG. 4), and a main coiled body 96. The second end 92 is shown comprising a first elongated body 98 and a second elongated body 100, positioned at an angle, such as 90 degrees from the first elongated body 98. In this arrangement, the second elongated body 100 can be inserted within opening 102 of the support structure bracket 94, thus resting inside of the support structure bracket 94, with the first elongated body 98 resting along an outer surface of the support structure bracket 94.

Figure 13:
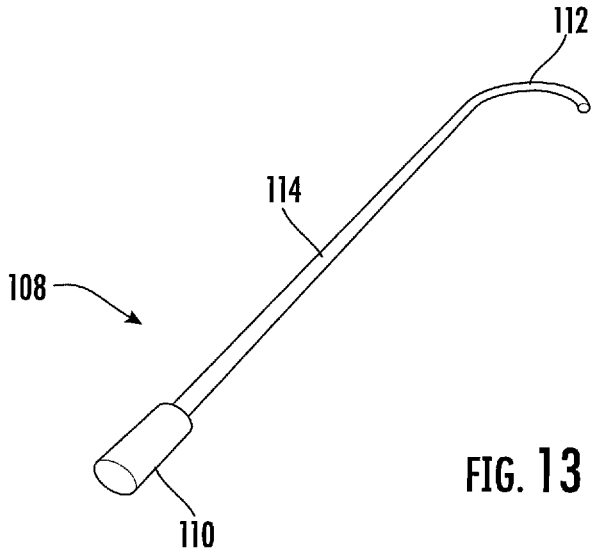
FIG. 13 is an illustrative embodiment of an actuator wire.
Figure 14:
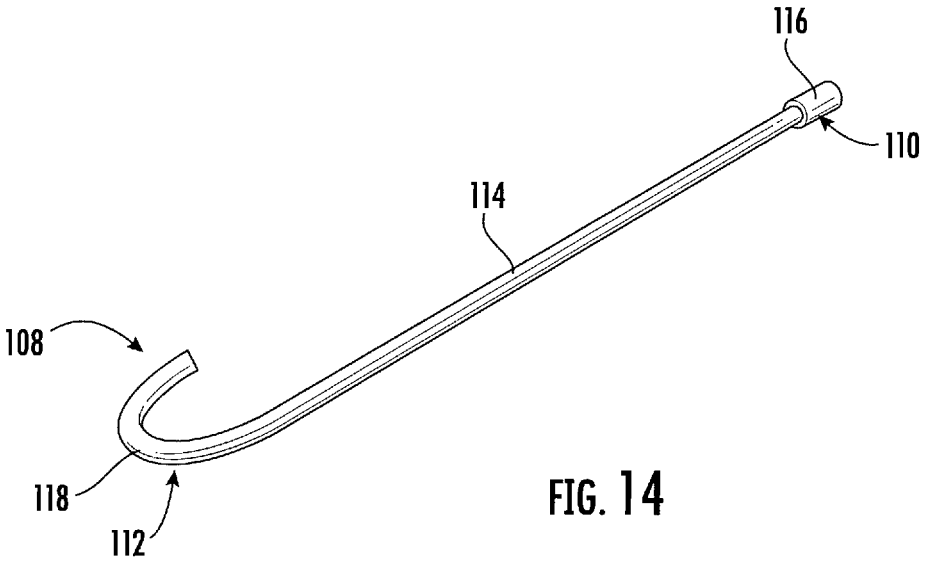
FIG. 14 is an alternative view of the actuator wire.
Figure 15:
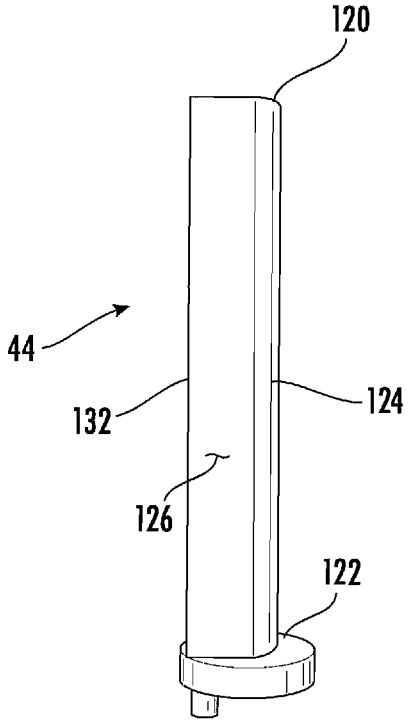
FIG. 15 is a perspective view of an illustrative example of a tape dispenser blade.
Figure 16:
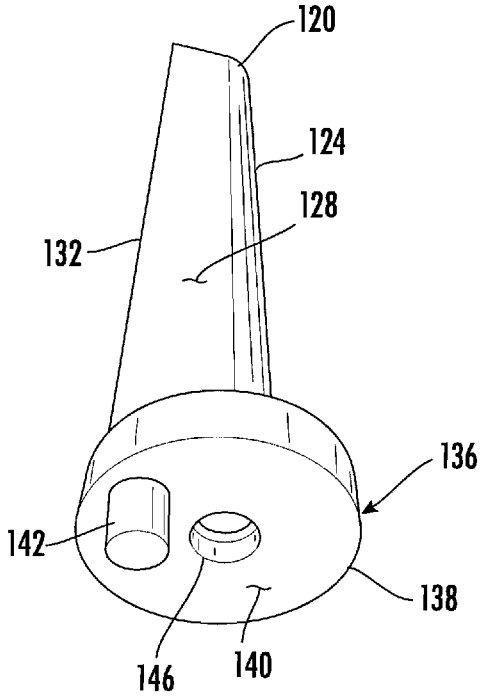
FIG. 16 is a bottom perspective view of the tape dispenser blade.
Figure 18:
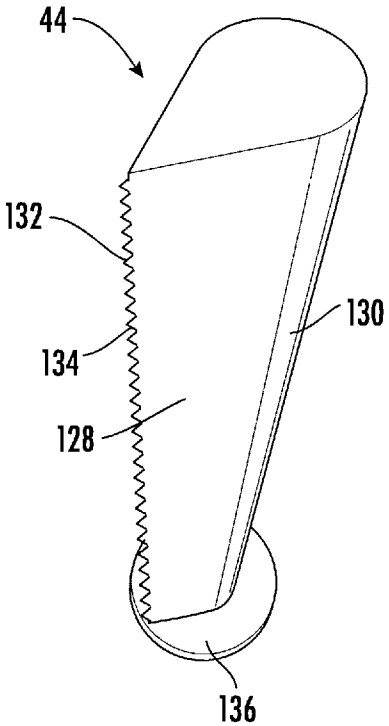
FIG. 18 is an illustrative embodiment of a tape dispenser blade with a serrated cutting edge.
Figure 17B:
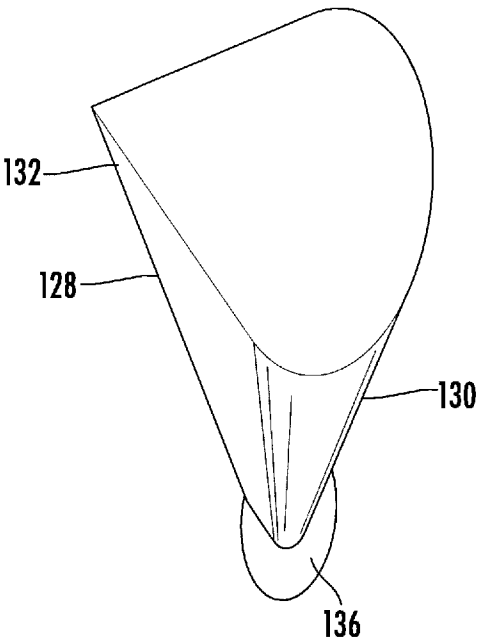
FIG. 17B is a top left side perspective view of the tape dispenser blade.
Figure 17A:
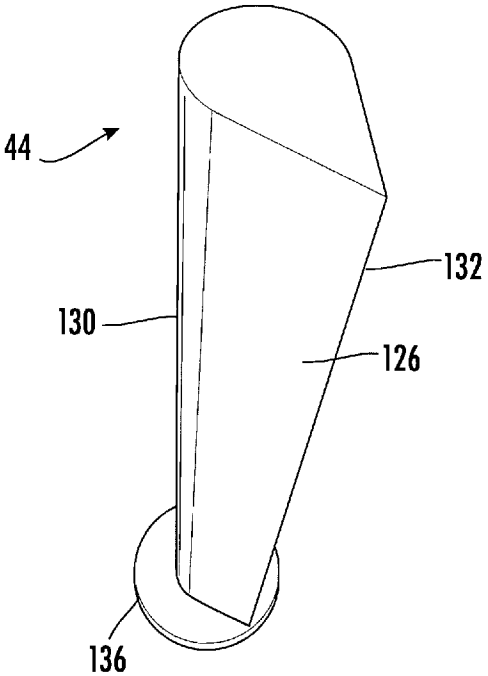
FIG. 17A is a right side perspective view of the tape dispenser blade.

The second actuator structure securing bracket 86 comprises a main body 104 having an open end sized and shaped to receive and secure therein a first end of an actuator component, such as an actuator wire 108, see FIGS. 13 and 14. The actuator wire 108 comprises a first end 110 configured to secure to the second actuator structure securing bracket 86, a second end 112 configured to secure to an actuator (to be described later), and an elongated body 114 therebetween. The actuator wire 110 is shown having a generally cylindrical shape 116 sized to fit and secure within opening 117 (see FIG. 8) of the second actuator structure securing bracket 86, resting within. The second actuator structure securing bracket second end 112 comprises a hooked or curved portion 118.

To aid in removing portions of tape from a tape roll, the tape dispenser 10 may include the tape dispenser blade 44 positioned within the blade channel slot 42. Referring to FIGS. 15-18, an illustrative example of the tape dispenser blade 44 is shown. The tape dispenser blade 44 has a first end 120, a second opposing end 122, and a main body 124 therebetween. The tape dispenser blade 44 contains a first surface 126, second surface 128, and a third surface 130 (shown as a curved or rounded surface) separating the first surface 126 and the second surface 128 at one end. At the second end 122, the first surface 126 and the second surface 128 meet at a cutting edge 132. The cutting edge 132 may be smooth. Alternatively, the cutting edge 132 may contain serrations 134, see FIG. 18. The tape disperser blade first surface 126 and second surface 128 are configured to receive and hold a portion of the tape. Accordingly, each of the surfaces 126, 128 may be planar and smooth.

Figure 19:
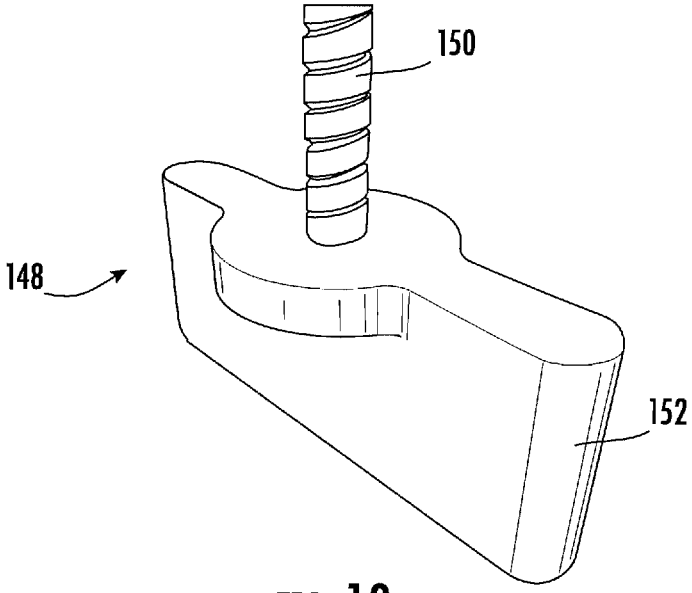
FIG. 19 is an illustrative example of a set screw.
Figure 20A:
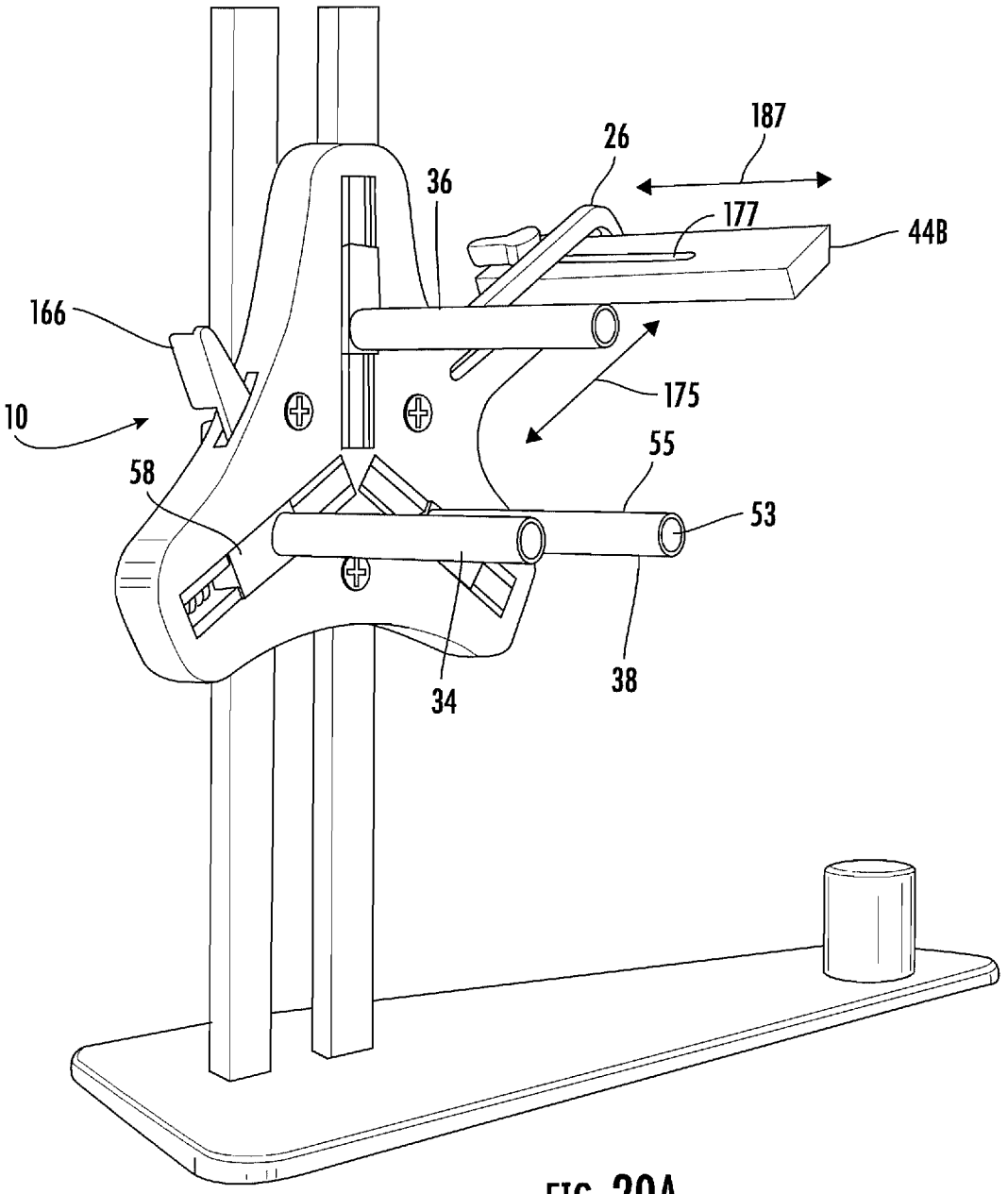
FIG. 20A is a front perspective view of the tape dispenser secured to a stand.
Figure 20B:
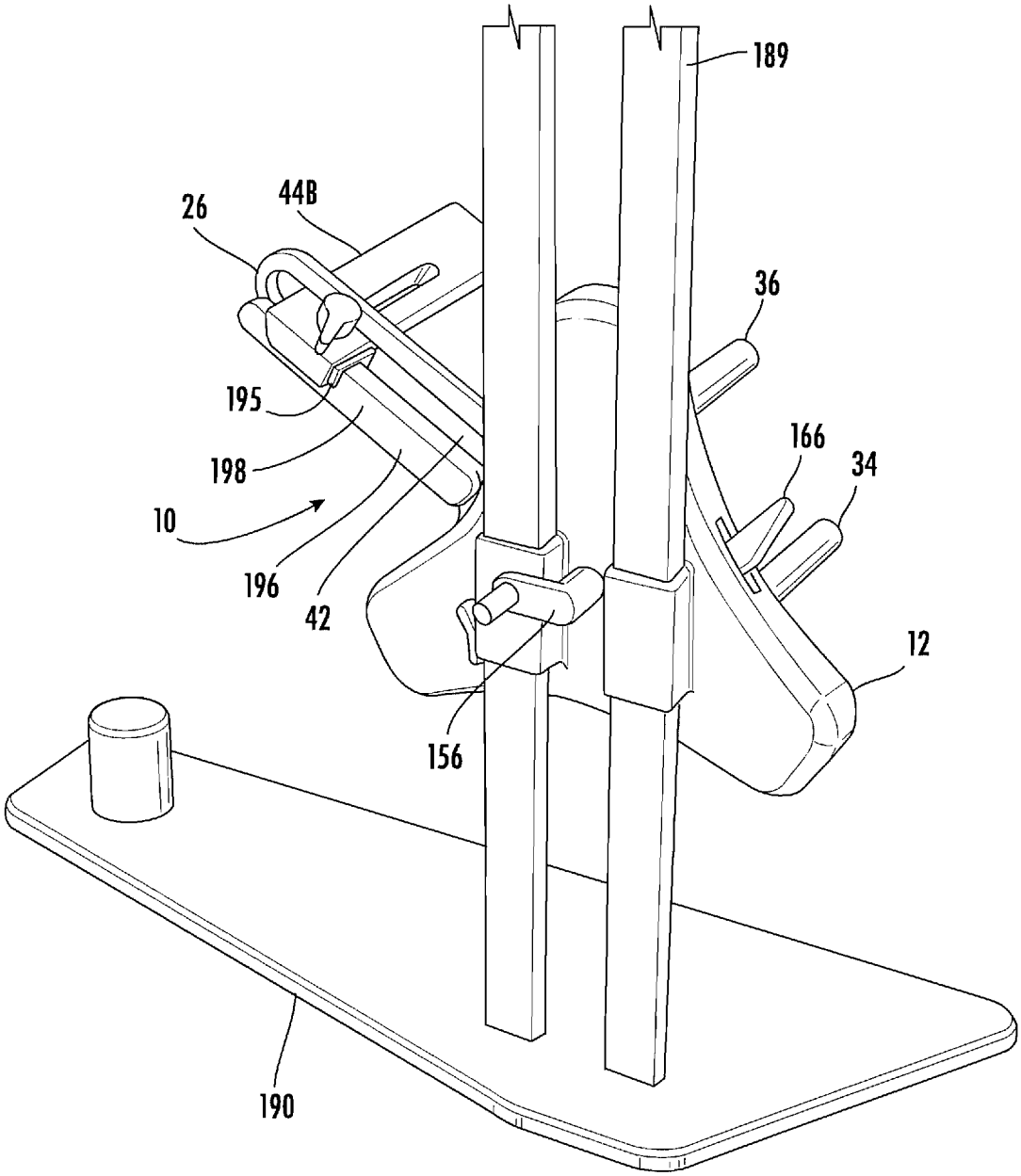
FIG. 20B is a back perspective view of the tape dispenser secured to a stand shown in FIG. 20A.
Figure 20C:
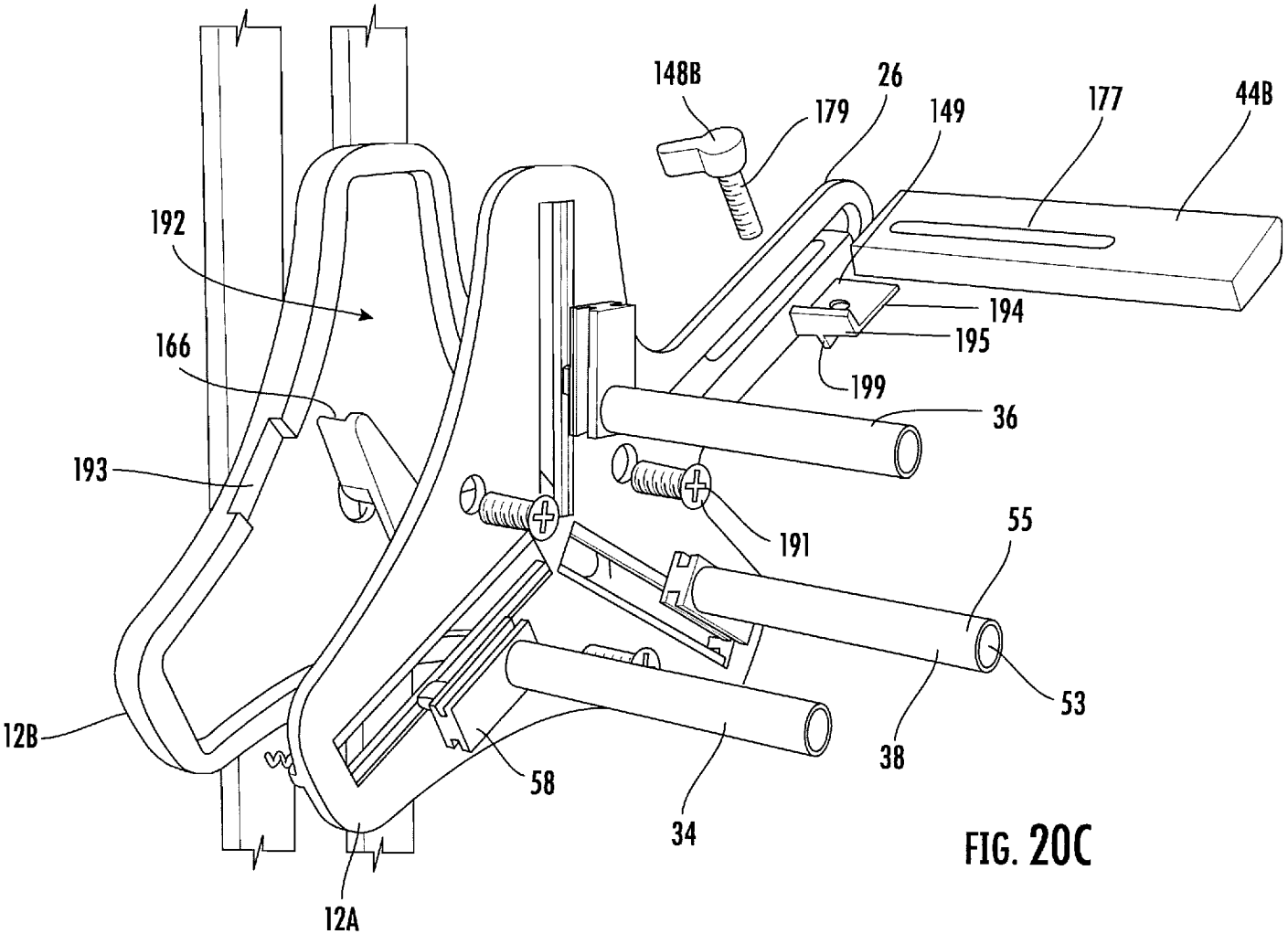
FIG. 20C is ab alternative view of the tape dispenser secured to a stand shown in FIG. 20A.
Figure 20D:
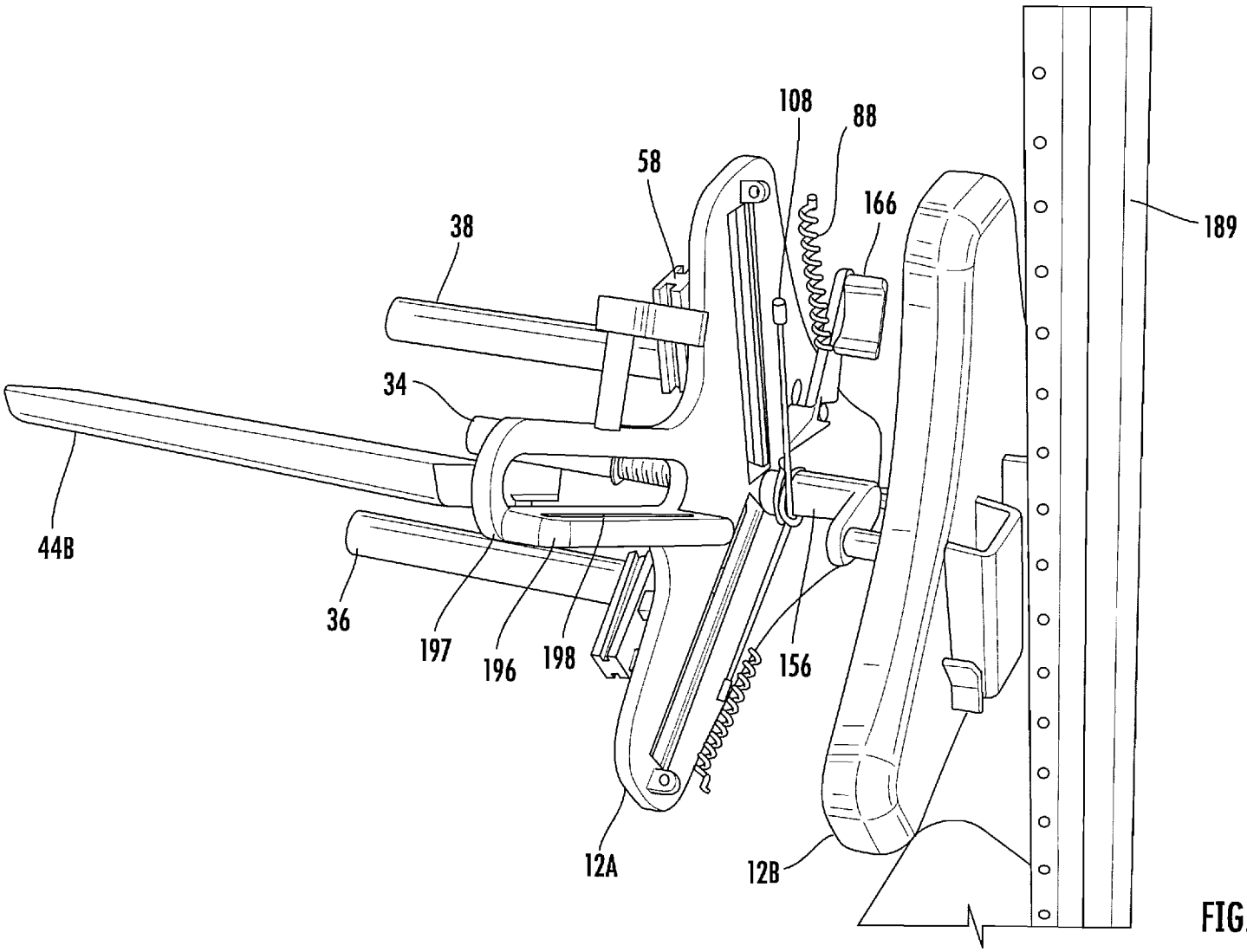
FIG. 20D is an exploded view of the tape dispenser secured to a stand shown in FIG. 20A.

Secured to or integrally formed from the tape disperser blade second opposing end 122 is a blade channel engagement member 136. The blade channel engagement member 136 is configured to allow the tape disperser blade 44 to engage with the blade channel slot 42, allowing linear (up and down) movement within the blade channel slot 42, as well as rotating (and fixing) the angle of the blade 44 positioned within the blade channel slot 42. The blade channel engagement member 136 is shown with a generally circular body 138 having a bottom surface 140 that engages with the support structure first surface 14. A guide member, illustrated herein as a cylindrical body 142, extends out and away out from the channel engagement member circular body bottom surface 140. The guide member cylindrical body 142 is sized and shaped to fit and remain within the blade channel slot 42. To maintain the tape disperser blade 44 in a particular location and positioned within the blade channel slot 42, the channel engagement member circular body bottom surface 140 comprises an opening 146 sized and shaped to receive a securing member, illustrated herein as a set screw 148 (see FIG. 2A). Insertion of the threaded body 150 of the set screw 148, see FIG. 19, into the threaded opening 146, and turning the set screw head 152 secures the tape dispenser blade 44 in position within the blade channel slot 42. Unscrewing the set screw 148 and moving the tape dispenser blade 44 allows the user to reposition (and then re-secure) the tape dispenser blade 44 anywhere within the blade channel slot 42.

Figure 2A:
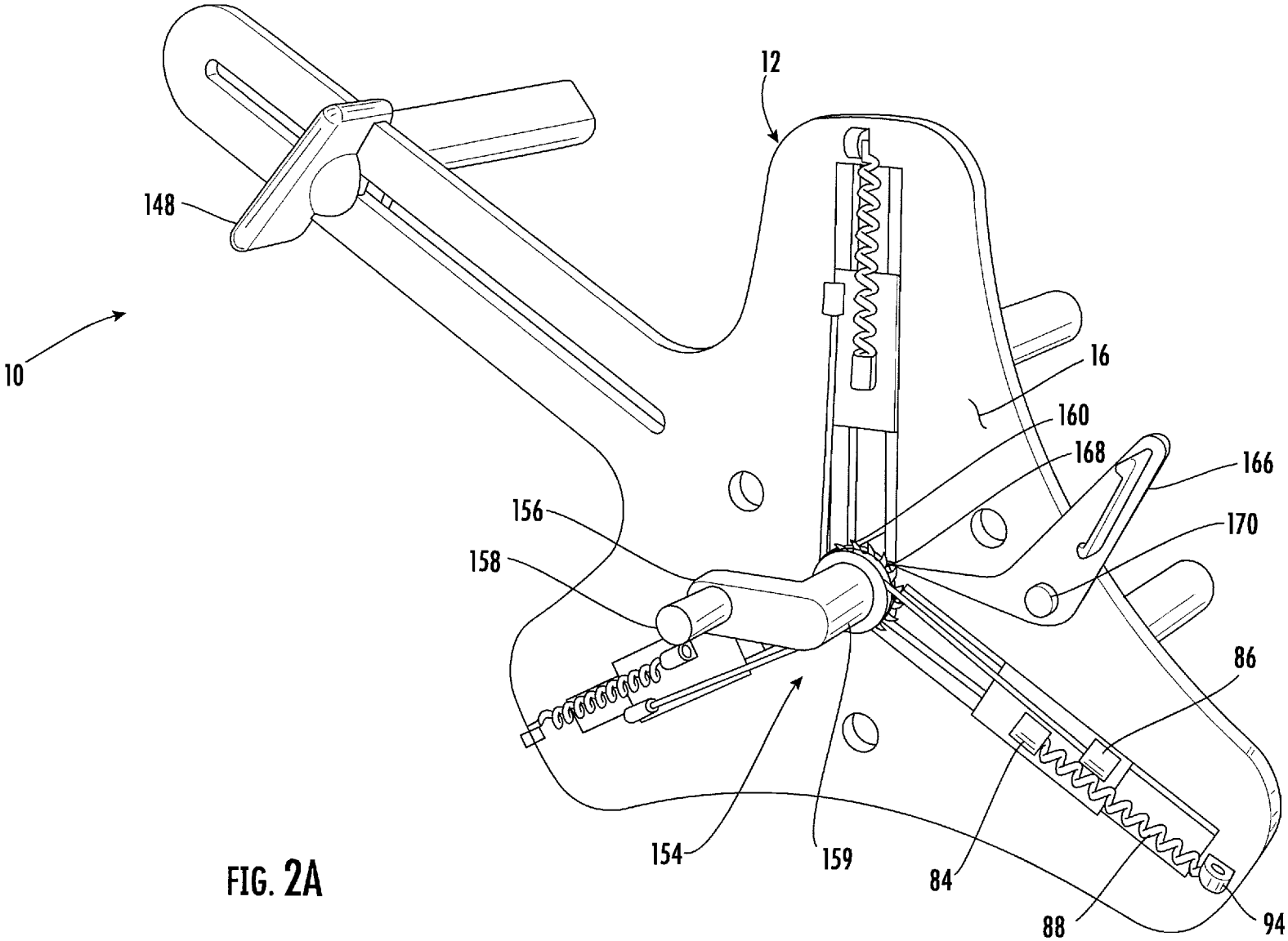
FIG. 2A is a perspective view of the tape dispenser illustrated in FIG. 1, showing a second, lower surface.
Figure 2B:
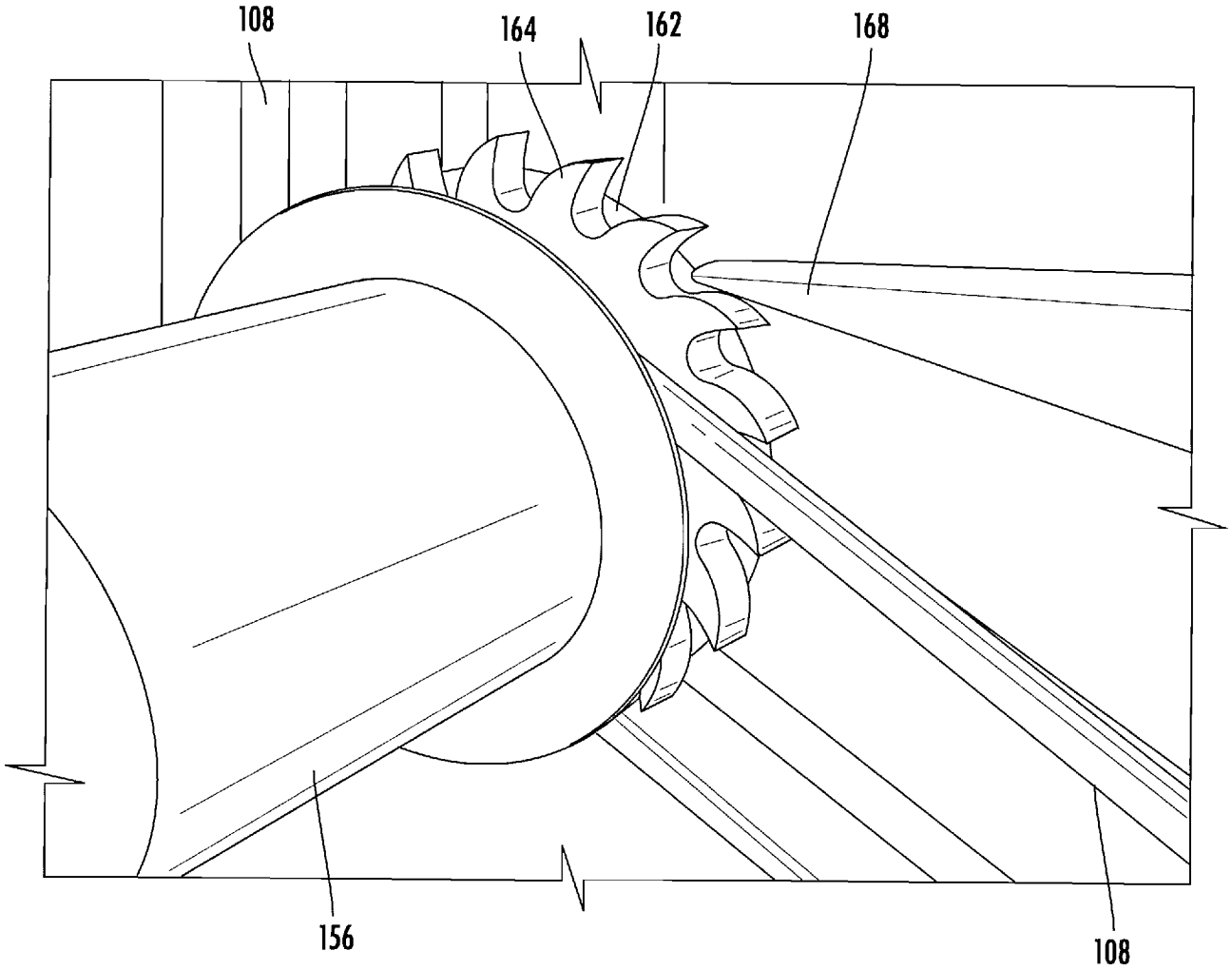
FIG. 2B is a close-up view of the actuator system.
Figure 2C:
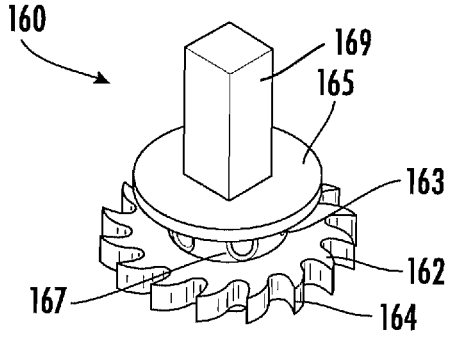
FIG. 2C is a top perspective view of the actuator system center body.
Figure 2D:
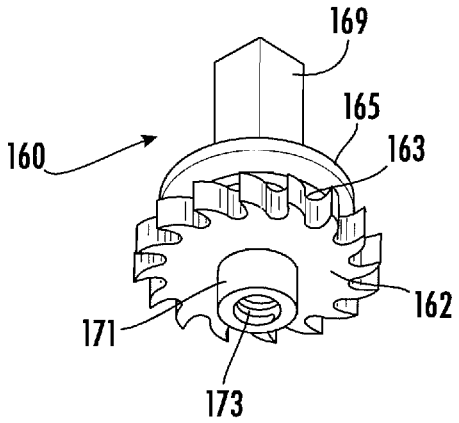
FIG. 2D is a bottom perspective view of the actuator system center body.
Figure 2E:
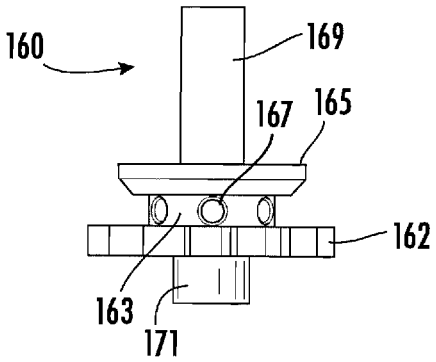
FIG. 2E is a side view of the actuator system center body.
Figure 21A:
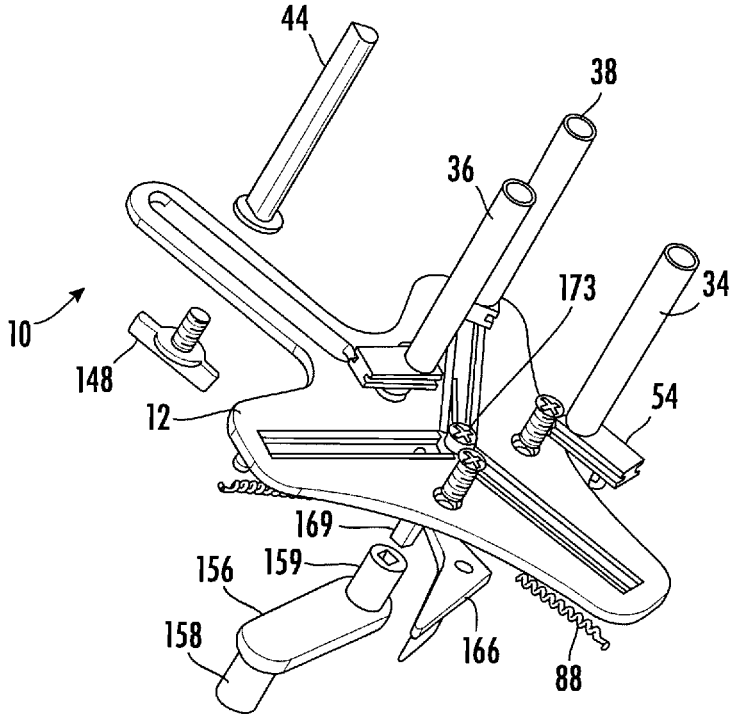
FIG. 21A is an exploded view of the tape dispenser.
Figure 21B:
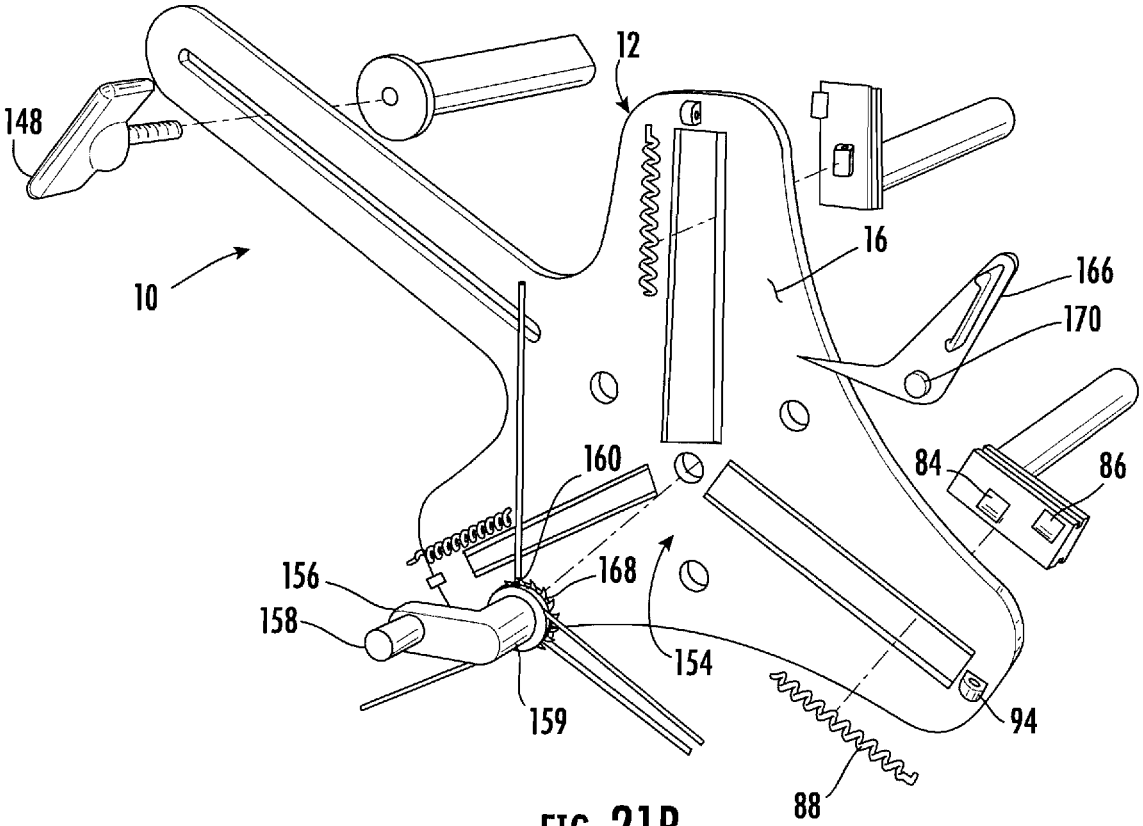
FIG. 21B is an alternative exploded view of the tape dispenser shown in FIG. 21A.

To aid in the process of loading or unloading a roll of tape to the support structure 12, an actuator, referred to generally as an actuator system 154, may be utilized, see FIGS. 2A and 2B. The actuator system 154 is designed to move, in a linear direction, the first tape holder slider 34, the second tape holder slider 36, and the third tape holder slider 38 within the respective slider channel slots, 28, 30, and 32. The actuator system 154 may comprise a handle 156 with knob 158 secured to a center body 160. The center body 160 may have a ratchet gear 162 with teeth 164 and a receiving body 163 extending from an upper plate 165. The receiving body 163 is sized and shaped to receive and hold the hooked end portion(s) 118 of the actuator wire(s) 108 via one more hooked end portion receiving members, illustrated herein as openings 167, see FIGS. 2C-2E. Preferably, all three actuating wires 108 (one each for the first tape holder slider 34, the second tape holder slider 36, and the third tape holder slider 38) secure to the receiving body 163 so that, as the handle 156 is rotated, the first tape holder slider 34, the second tape holder slider 36, and the third tape holder slider 38 all move in the same direction at the same time. The center body 160 may have un upper stem 169 sized and shaped to fit into and secure to the body of handle 156 (via actuator system center body receiving member 159, see FIG. 2A, FIG. 21A, FIG. 21B) and a lower stem 171 having a threaded opening 173 for receiving a threaded object, such as screw 173, see FIG. 21A or 21B.

The center body 160 is designed with a ratcheting mechanism to ensure that the entire mechanism, and thus each individual first tape holder slider 34, second tape holder slider 36, or third tape holder slider 38, does not randomly open up or move within their respective channels. A release lever 166 with a pawl 168 which moves around pivot 170 allows the first tape holder slider 34, the second tape holder slider 36, or the third tape holder slider 38 to open up when the lever is pulled, thus creating a tension. In use, the first tape holder slider 34, the second tape holder slider 36, or the third tape holder slider 38 are positioned at a place within the respective slider channel slots, 28, 30, and 32, providing a first or resting position. Such position is preferably as far from the center as possible.

The tape dispenser 10 functions by keeping the first tape holder slider 34, the second tape holder slider 36, or the third tape holder slider 38 in tension. Each of the associated actuator wires 108 can be used to wind each slider. The use of springs 88 are designed to hold tension in the opposite direction. Such design allows tension allows each spring to be in a constant state of tension when the tape roll is placed on the tape dispenser 10.

To load a roll of tape onto the support structure 12, a user may engage the actuator system 154 by grabbing the knob 158 and rotating the handle 156. As the handle 156 is rotated, each of the first tape holder slider 34, the second tape holder slider 36, or the third tape holder slider 38 are drawn closer to the center by moving inwardly within the slider channel slots, 28, 30, and 32, all at the same time. Drawing each of the first tape holder slider 34, the second tape holder slider 36, or the third tape holder slider 38 toward the center allows a smaller diameter sized tape roll to fit onto the support structure 12. Positioning the first tape holder slider 34, the second tape holder slider 36, or the third tape holder slider 38 further away from the center allows larger diameter sized tape rolls to fit onto the support structure 12. Such movement inwardly towards the center also causes extension of the springs 88. As the handle 156 is turned, the ratchet 160 prevents backward movements. In addition, the ratchet 160 provides for gradual movement of the first tape holder slider 34, the second tape holder slider 36, or the third tape holder slider 38. Once the desired location of the first tape holder slider 34, the second tape holder slider 36, or the third tape holder slider 38 within the channels is obtained corresponding to the size (or diameter) of the roll of tape, the interior portion 172 (see FIG. 5B) of the roll of tape (see 45, FIG. 5B) surrounds first tape holder slider 34, second tape holder slider 36, or third tape holder slider 38, in contact with each slider outer surface 174. Releasing the lever 166 causes each of the first tape holder slider 34, the second tape holder slider 36, or the third tape holder slider 38 to move back towards the initial, or resting position, as the springs 88 compress, thus holding the roll of tape in place.

Figure 21C:
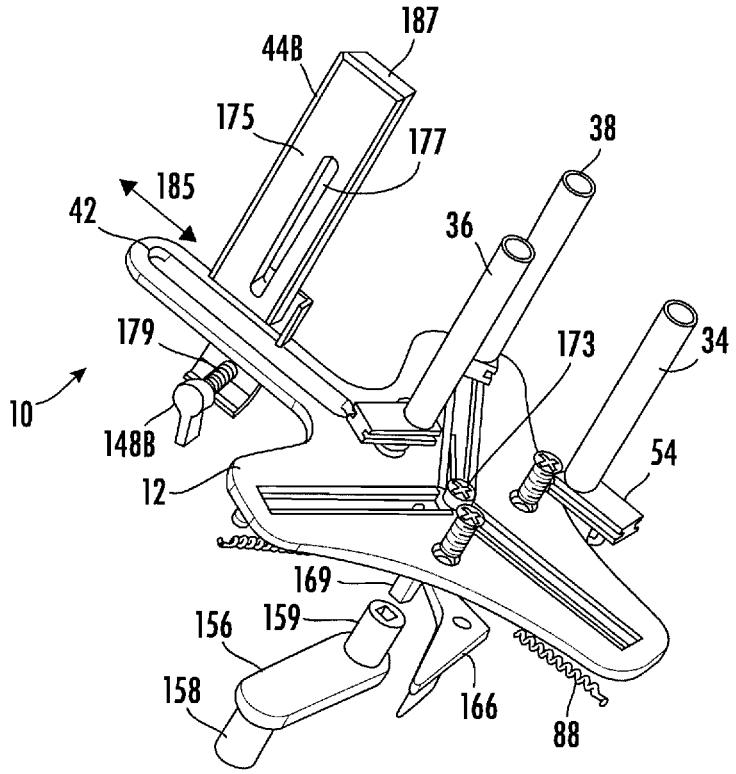
FIG. 21C is an exploded view of the tape dispenser having a tape dispenser blade bracket.
Figure 21D:
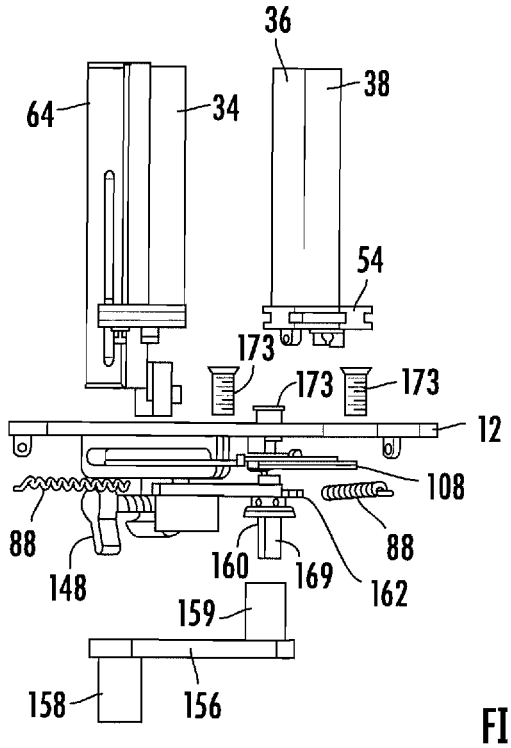
FIG. 21D is an alternative exploded view of the tape dispenser shown in FIG. 21C.

Referring to FIGS. 21C and 21D, the tape dispenser 10 is illustrated with an alternative tape dispenser blade, referred to as tape dispenser blade 44B. The tape dispenser blade 44B may include an upper surface 175 for which a portion of the tape may rest thereupon. The upper surface 175 may also include a slotted opening 177 sized and shaped to receive a stem 179 of a handle 148B. To support the tape dispenser blade 44B in a position, a tape dispenser blade support bracket 181 may be used. The tape dispenser blade support bracket 181 may include a flanged or upwardly extended surface 183 to act as a tape dispenser blade stop. In use, the tape dispenser blade 44B may be secured to the tape dispenser blade support bracket 181 via insertion of the handle stem 179 (which may be threaded) therein, and fastened with a nut (not shown).

In this configuration, the tape dispenser blade 44B can be moved along a first axis, see arrows 185 and/or along a second axis, see arrows 187. Accordingly, along the first axis, the tape dispenser blade 44B can be moved (up/down) and positioned closer to or further away from the center of the tape dispenser 10 as the tape dispenser blade 44B moves along (parallel to) the longitudinal axis of the blade channel slot 42. Along the second axis, the tape dispenser 10 is moved left or right, perpendicular to the longitudinal axis of the blade channel slot 42 so that edge 187 the tape dispenser blade 44B can be moved closer to or further from the center. The tape dispenser blade 44B may contain a serrated edge to aid in cutting of the tape.

The tape dispenser 10 is configured to be hand held. However, the tape dispenser 10 may be mounted to a secondary support through one or more holes 178 (see FIG. 3) in support structure 12. FIGS. 21A-21D illustrate an embodiment of the tape dispenser 10 secured to posts 189 of stand 190. The tape dispenser 10 illustrates a support structure 12 configured as a two-piece unit, with a first piece 12A and a second piece 1B held together by screws 191 and creating an interior 192. A cut-out section 193 within the second piece 1B provides freedom for the release lever 166 move therein. The second opposing end is shown with the blade channel slot 42 having the tape dispenser blade 44B. The tape dispenser blade 44B is held in place with a slightly different mechanism as described above. Either mechanism may be used.

As illustrated in the figures, a tape dispenser blade support bracket 194, with flanged or upwardly extended surface 195, aids in securing the tape dispenser blade 44B within the blade channel slot 42. The tape dispenser blade 44B may be secured to the second opposing end 26 via a guide member, illustrated herein as an elongated body or flange 196 secured to or extending from surface 197 of the finger-like shaped portion of second opposing end 26. The elongated body or flange 196 contains a recessed channel 198, preferably spanning the distance thereof and sized and shaped to receive and hold tape dispenser blade support bracket guide posts 199. The tape dispenser blade 44B is secured to the tape dispenser blade support bracket 194 via insertion of the handle stem 179 via opening 149 (and may be secured with a nut). Once the hold tape dispenser blade support bracket guide posts 199 are inserted and resting within the recessed channel 198, the tape dispenser blade support bracket 194 may be slide linearly up or down.

This arrangement allows the tape dispenser blade support bracket 194 to be move up/down within the blade channel slot 42. In addition, the tape dispenser blade 44B can be positioned and secured at different places within the blade channel slot 42 be securing to different locations within the slotted opening 177. This allows the tape dispenser blade 44B to move and be positioned within two axes of movement, the first axis (up/down) 177 or second axis (left/right) 187, as described above. Alternatively, the blade channel slot 42 may include the tape dispenser blade 44.

Referring to FIGS. 22-25, an alternative embodiment of the device for dispensing a rolled item, referred to generally as a tape dispenser 200 The tape dispenser 200 may comprise many of the same features as described in tape dispenser 10. Where the structural components are the same, the reference numbers used to describe such components for the tape dispenser 10 will be used for tape dispenser 200.

Figure 22:
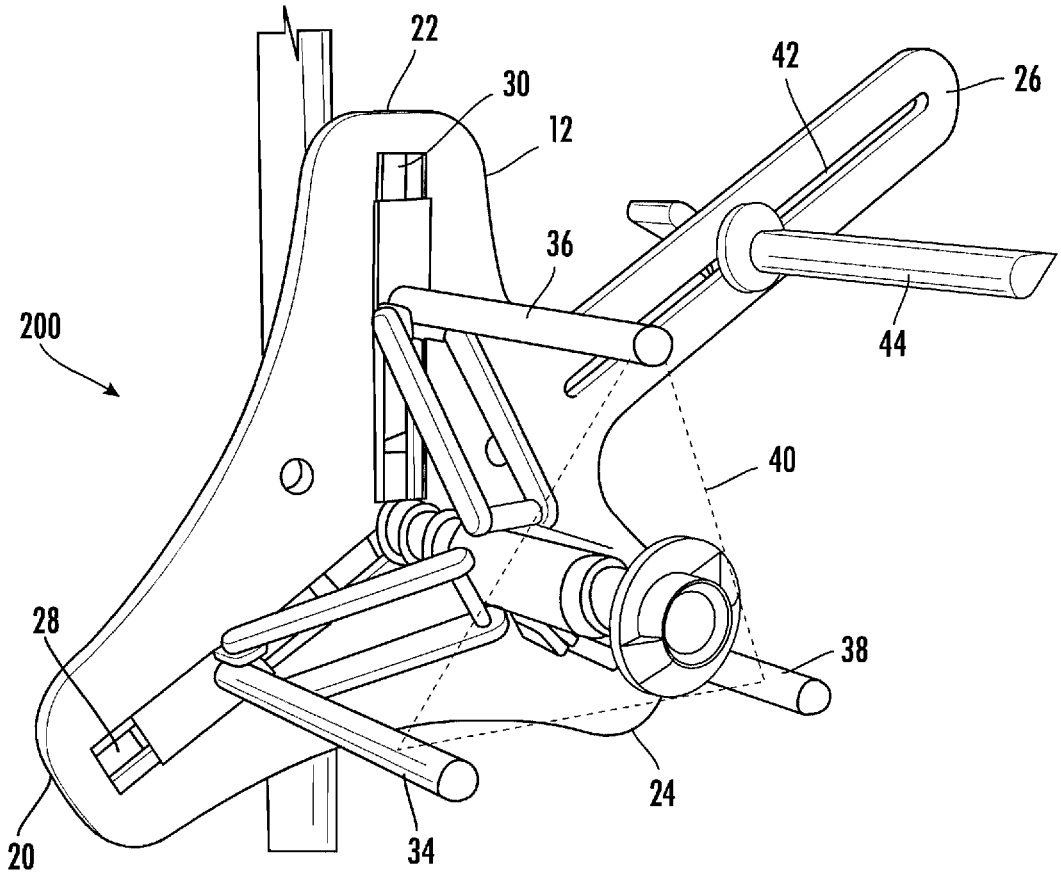
FIG. 22 is a perspective view of an alternative embodiment of the tape dispenser.

The support structure 12 of tape dispenser 200 has the same tripod-like shape and structural features as that described above. Briefly, support structure 12 of tape dispenser 200 comprises the main body 16 having a first end 20, two side ends 22 and 24, and a second end 26 opposing the first end 20. The second opposing end 26 may be configured to have a different profile, such as a smaller size or width as compared to the first end 20, or the two side ends 22 and 24. One or more, preferably a plurality of open slots, referred to as slider channel slots 28, 30, and 32 are cut or formed into the support structure 12. Each of the slider channel slots 28, 30, and 32 may extend from a portion at or near the center of the support structure 12, towards the first end 20 or two side ends 22 and 24. Slider channel slot 28 is sized and shaped to operatively interact with and hold a first tape holder slider 34. Slider channel slot 30 is sized and shaped to operatively interact with and hold a second tape holder slider 36. Slider channel slot 32 is sized and shaped to operatively interact with and hold a third tape holder slider 38. The slider channel slots 28, 30, and 32 may be orientated on the support structure 12 at angles, such as forming or having a Y-shape configuration, relative to each other so that when the first tape holder slider 34, the second tape holder slider 36, and the third tape holder slider 38 are placed within the slider channel slots 28, 30, and 32, the sliders 34, 36, and 38 are orientated to form a triangular plane 40 (FIG. 22).

The support structure 12 may also contain an additional open slot, referred to as a blade channel slot 42. The blade channel slot 42 may be cut or formed into the support structure 12, and associated with the second opposing end 26. The blade channel slot 42 may extend from a portion at or near second opposing end 26, and extend in the direction towards the center of the support structure 12. The blade channel slot 42 is sized and shaped to operatively interact with and hold a tape dispenser blade 44 (See FIG. 22). Except where noted, mostly related to the actuation mechanism, the slider channel slots 28, 30, and 32, the sliders 34, 36, and 38, and tape dispenser blade 44 have the same structural components or features as described above. Since the tape dispenser 200 uses a different actuating mechanism, the sliders 34, 36, and 38 would not require the structural components of the first compression unit securing bracket 84 and the second actuator structure securing bracket 86.

Figure 25:
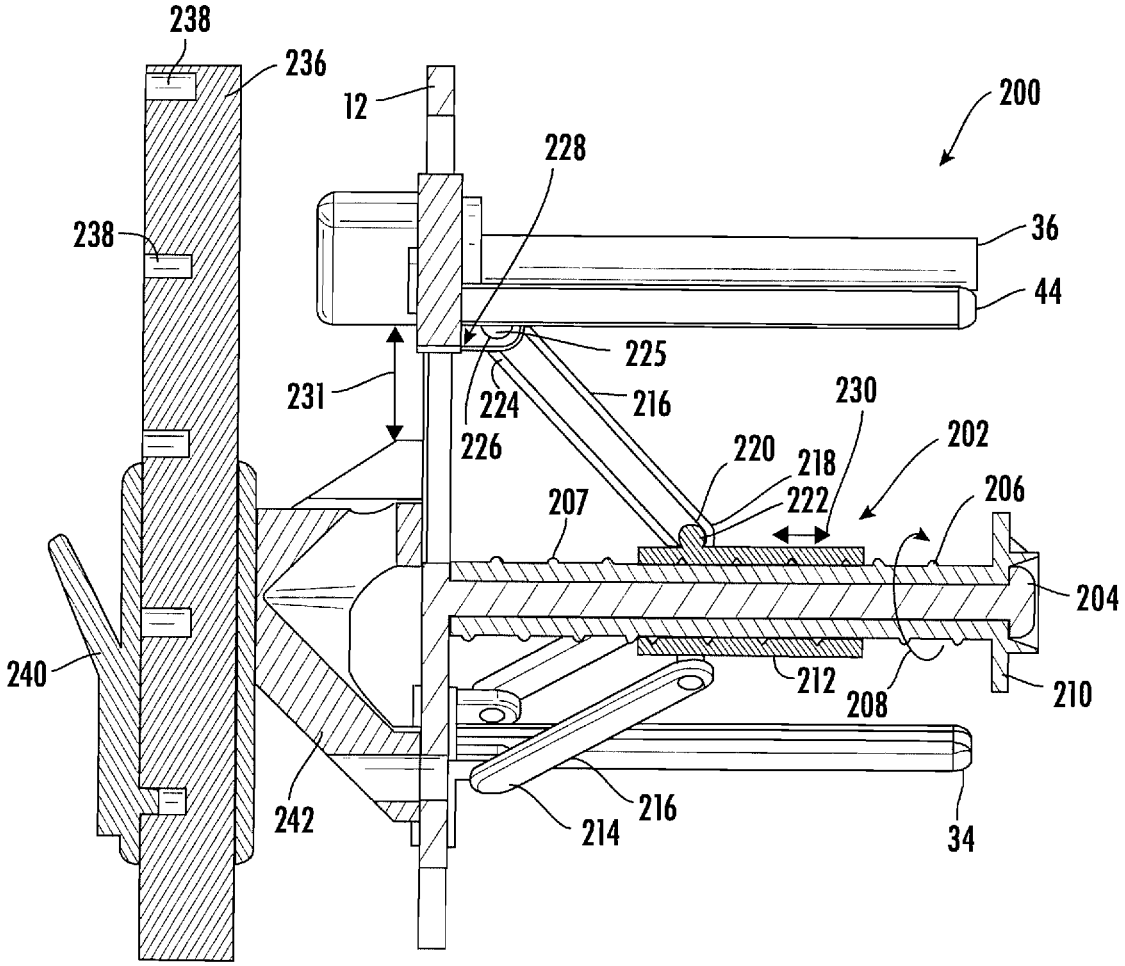
FIG. 25 is a cross-sectional view of the tape dispenser illustrated in FIG. 22.

To aid in the process of loading or unloading a roll of tape to the support structure 12, an actuator, referred to generally as an actuator system 202, may be utilized, see FIG. 25. The actuator system 202 is designed to move, in a linear direction, the first tape holder slider 34, the second tape holder slider 36, and the third tape holder slider 38 within the respective slider channel slots, 28, 30, and 32. The actuator system 202 may comprise an elongated body 204 secured to or integrally formed from the support structure 12. The elongated body 204 is preferably a rigid body, extending upwardly, or away from the support structure 12, and configured to hold parts of the actuator system 202 in place. Surrounding the elongated body 204, thus forming a coaxial alignment, is a free rolling screw 206, shown with threading 207 designed to roll or move in the direction of arrow 208. The rolling screw head 210 is configured to be manipulated, i.e. turned by hand, similar to a bottle cap. Secured to the outer perimeter of the rolling screw 206 is a collar 212. The rolling screw head 210 may contain a Phillip's head (cross-shaped grooves), flat/slotted head, or hex-shaped recession to aid (via use of corresponding shaped screw drive) in rotating the rolling screw 206. Alternatively, the rolling screw head 210 may include a tab or pop-up tab to accomplish the same.

Figure 23:
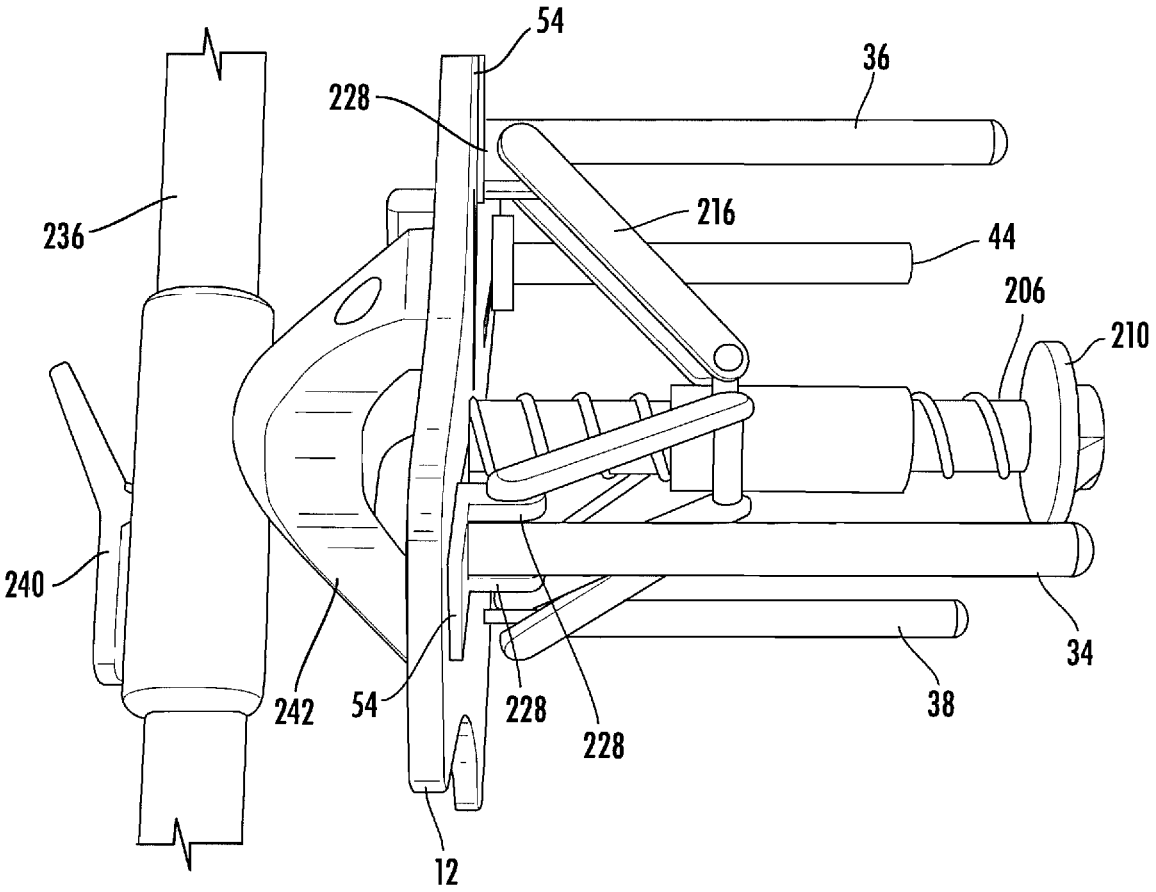
FIG. 23 is an alternative view of the tape dispenser illustrated in FIG. 22.
Figure 24:
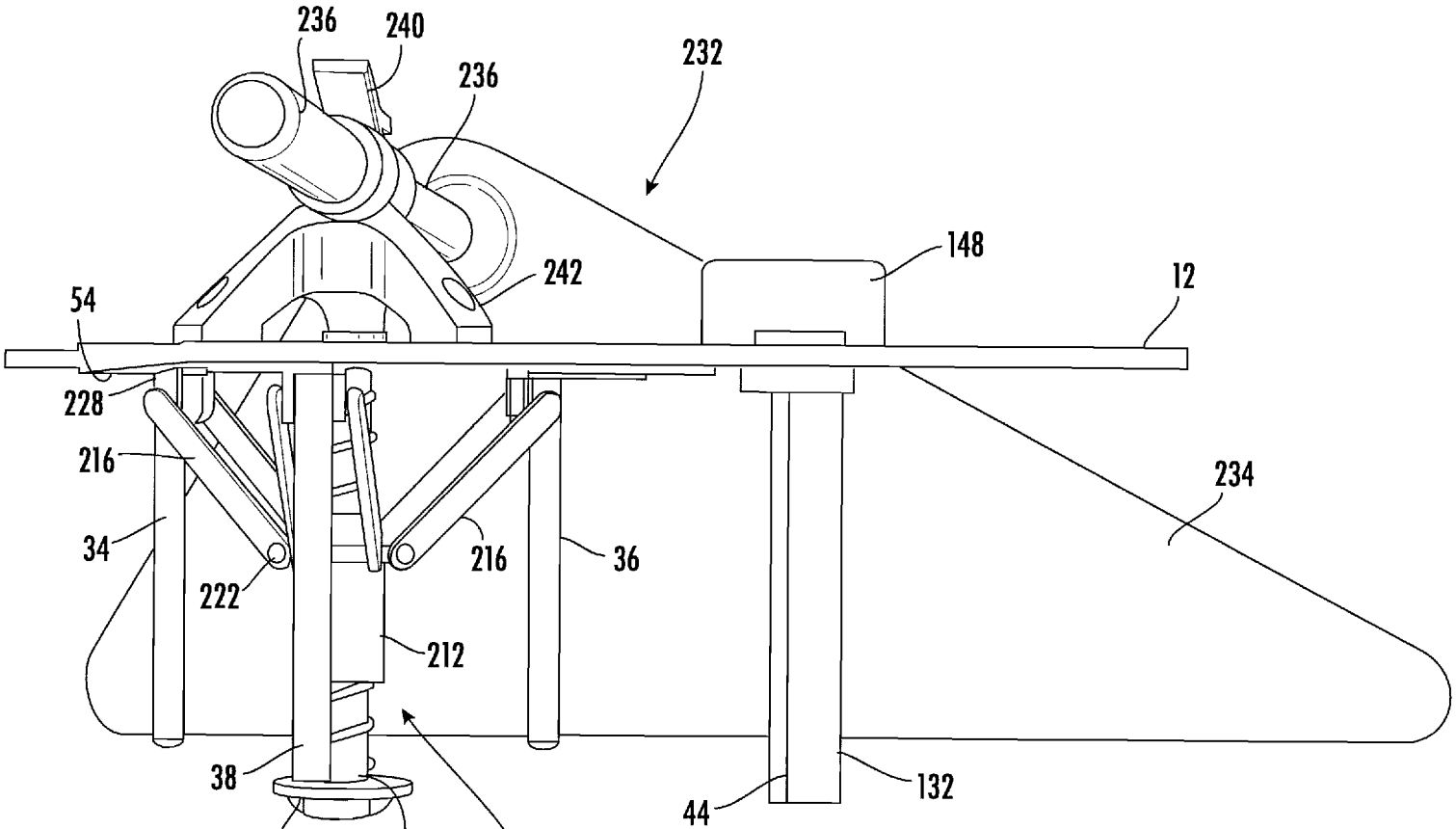
FIG. 24 is a top view of the tape dispenser illustrated in FIG. 22.

The collar 212 is operatively coupled to a bracket 214. The bracket 214 contains two arms 216. Each arm 216 comprising a first end 218 having an opening 220 sized and shaped to receive a bracket to sleeve engaging member, illustrated herein as a crossbar 222. As illustrated, there are three crossbars 222 arranged around the perimeter of the collar 212. A second end 224 contains a bracket to slider engaging member, illustrated herein as a pin 225. The pin 225 is sized and shaped to be inserted into opening 226 of the slider engaging member arm 228. Referring to FIG. 23, the slider engaging member arm 228 is shown extending upwardly, away from the slider channel slot coupling member main body slider plate 56, with a space between each of the arms 228 sufficient to allow a slider 34, 36, or 38 to fit and rest within.

As the rolling screw 206 is rotated, the collar 212 moves in linear directions, see arrow 230, FIG. 25. As the collar 212 moves back and forth, the bracket arms 216 translate the longitudinal motion into vertical movement, eventually moving the main body slider plate 56 within its respective channels, and thus the attached first tape holder slider 34, second tape holder slider 36, or third tape holder slider 38, to move (see arrow 231) closer together or further apart depending on the inner diameter of the tape roll.

The tape dispenser 200 may be utilized as a hand-held device. Alternatively, the tape dispenser 200 may be mountable to a support stand 232, see FIG. 24. The support stand 232 has a base 234 configured to rest on a generally planar, preferably horizontally orientated, surface and a vertical support 236, secured to or formed from the base 234. The vertical support 236 extends upwardly or away from the base 234. The vertical support 236 may contain one or more spaced apart holes 238 to allow for height adjustment. A spring-loaded clip 240 secured to a support structure mount 242 maintains the tape dispenser 200 in place about support stand 232. The support structure mount 242 has a sufficient height to maintain a space to allow the first tape holder slider 34, the second tape holder slider 36, or the third tape holder slider 38 to move.

Figure 26:
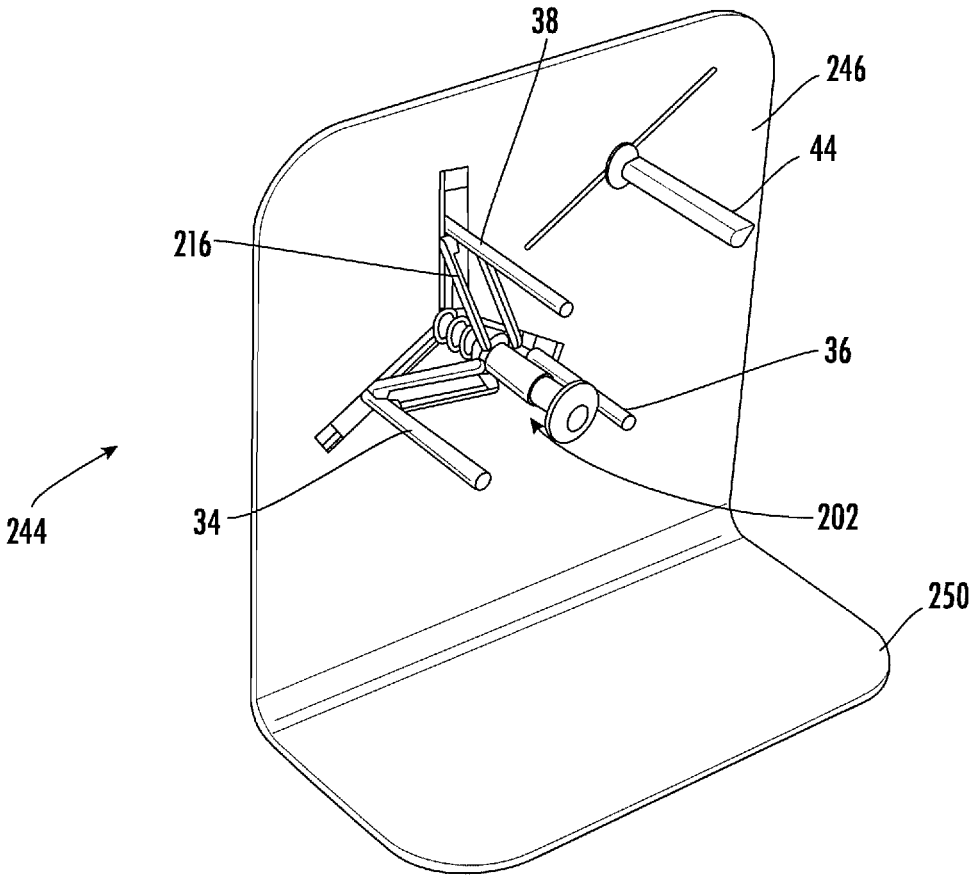
FIG. 26 is a front view of the tape dispenser having a table top support structure.
Figure 27:
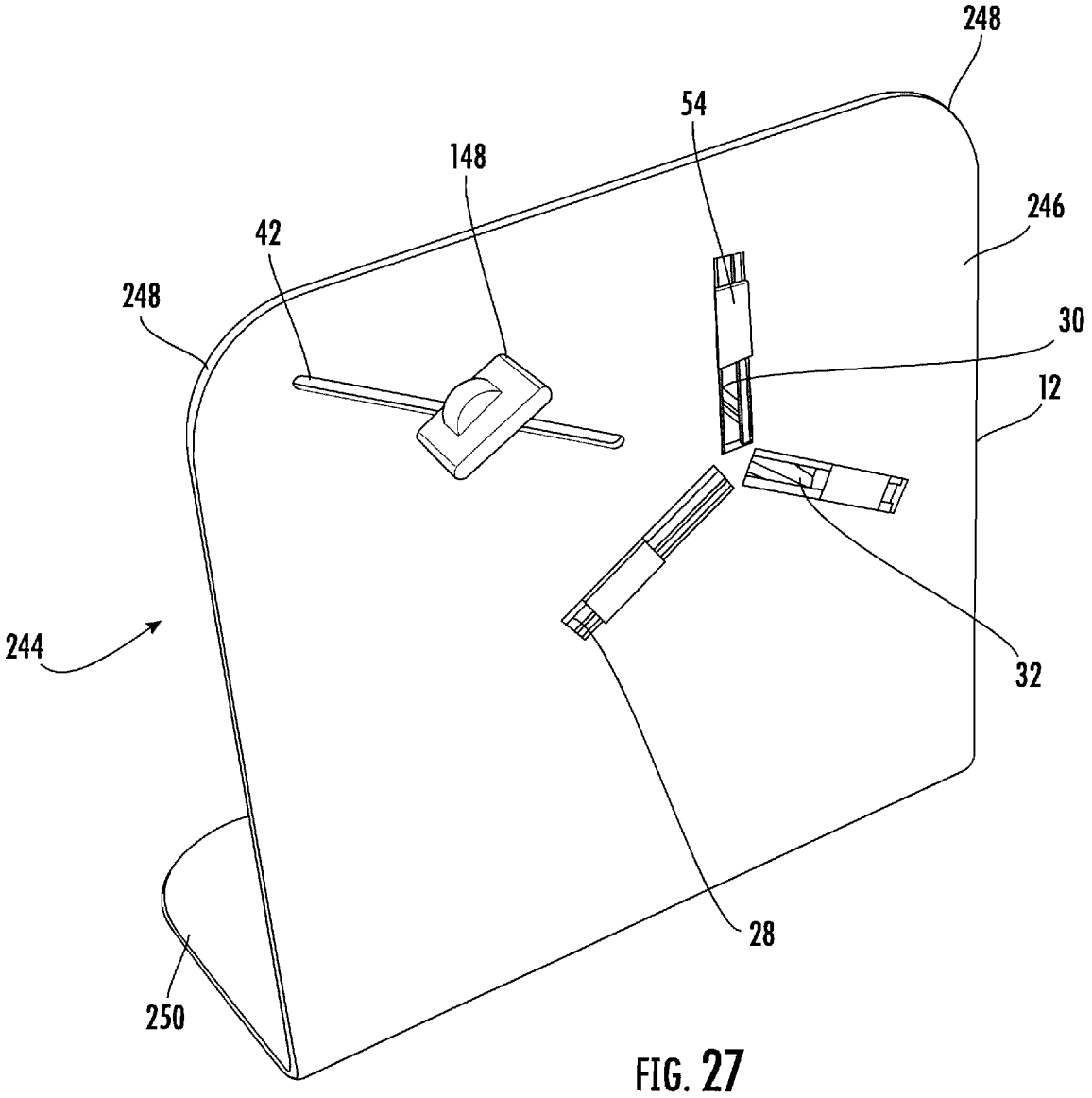
FIG. 27 is a back view of the tape dispenser illustrated in FIG. 26.

FIGS. 26-27 illustrate the tape dispenser 200 configured as a table top model 244 in which the support structure 12 comprises a first plate 246 having a planar and generally square shape cross section, with rounded edges 248. The first plate 246 is arranged in a generally vertical orientation relative to a surface (such as a table) it rests upon and contains the slider channel slots 28, 30, and 32. The slider channel slots 28, 30, and 32 may be orientated on the support structure 12 at angles, such as forming or having a Y-shape configuration. The first plate 246 also comprises the blade channel slot 42. To maintain balance while resting on a table or other surface, the support structure 12 comprises a second plate 250 extending from the first plate 246. The second plate 250 assumes a horizontal orientation relative to a surface it rests upon and is arranged at or close to a right angle with the first plate 246 to form an L-shaped configuration. Although not illustrated, the tape dispenser 10 may also have the same table top support structure 12.

The embodiments described in FIGS. 22-27 include the tape dispenser blade 44, however, any of the embodiments described for for tape dispenser blade 44*b* may be used as well.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for dispensing at least a portion of a rolled item comprising:

a support structure, having:

a body forming a thickness a first slider slot extending through the thickness of the body;

a second slider slot extending through the thickness of the body; and an elongated blade slot extending through the thickness of the body;

at least two tape holder sliders configured to be moveable from a first position to at least one second position, the at least two tape holder sliders are configured to slidingly engage with the first slider slot and the second slider slot;

a tape dispenser blade having a cutting edge, said tape dispenser blade be moveable from a first position to at least one second position along the elongated blade slot and to rotatable position said cutting edge at different angles; and an actuating system configured to move said at least two tape holder sliders from said first position to said at least one second position.

2. The device for dispensing at least a portion of a rolled item according to claim 1, wherein said at least two tape holder sliders are configured to engage with an inner portion of a rolled material.

3. The device for dispensing at least a portion of a rolled item according to claim 2, wherein said rolled material is tape.

4. A tape dispensing device for dispensing a tape comprising:

a support structure, having:

a body forming a thickness a first slider slot extending through the thickness of the body;

a second slider slot extending through the thickness of the body;

a third slider slot extending through the thickness of the body; and an elongated blade slot extending through the thickness of the body;

a first tape holder slider configured to be moveable from a first position to at least one second position, the first tape holder slider is configured to slidingly engage with the first slider slot;

a second tape holder slider configured to be moveable from a first position to at least one second position, the second tape holder slider is configured to slidingly engage with the second slider slot;

a third tape holder slider configured to be moveable from a first position to at least one second position, the third tape holder slider is configured to slidingly engage with the third slider slot;

an actuator operatively connected to said first tape holder slider, said second tape holder slider, and said third tape holder slider, wherein activation of said actuator moves said first, second, and third tape holder sliders simultaneously in a single direction; and a tape dispenser blade having a cutting edge, said tape dispenser blade being moveable from a first position to at least one second position along the elongated blade slot and rotatable to position said cutting edge at different angles.

5. The tape dispensing device for dispensing a tape according to claim 4, wherein said first slider channel slot, said second slider channel slot, and said third slider channel slot are arranged in generally y-formation.

6. The tape dispensing device for dispensing a tape according to claim 4, wherein said tape dispenser blade engages within a blade channel slot.

7. The tape dispensing device for dispensing a tape according to claim 6, wherein said tape dispenser blade includes a set screw for securing said tape dispenser blade in a position within said blade channel slot.

8. The tape dispensing device for dispensing a tape according to claim 4, wherein said first tape holder slider, said second tape holder slider, and said third tape holder slider comprise a sleeve.

9. The tape dispensing device for dispensing a tape according to claim 8, wherein said sleeve is made of a material that spins relative to an inner core as a tape roll mounted to said tape dispenser spins.

10. The tape dispensing device for dispensing a tape according to claim 4, wherein:

said first tape holder slider comprises a slider channel slot coupling member configured to operatively secure said first tape holder slider to said first slider channel slot;

said second tape holder slider comprises a slider channel slot coupling member configured to operatively secure said second tape holder slider to said first slider channel slot; and said third tape holder slider comprises a slider channel slot coupling member configured to operatively secure said third tape holder slider to said third slider channel slot.

11. The tape dispensing device for dispensing a tape according to claim 4, wherein said actuator includes a ratchet mechanism.

12. The tape dispensing device for dispensing a tape according to claim 4, wherein said actuator is operatively connected to said first tape holder slider via a first actuator wire, operatively connected to said second tape holder slider via a second actuator wire, and operatively connected to said third tape holder slider via a third actuator wire.

13. The tape dispensing device for dispensing a tape according to claim 12, wherein said actuator includes one or more springs.

14. The tape dispensing device for dispensing a tape according to claim 4, wherein said actuator includes a release lever.

15. The tape dispensing device for dispensing a tape according to claim 4, wherein said actuator includes a handle.

16. The tape dispensing device for dispensing a tape according to claim 4, wherein said tape dispenser cutting edge is serrated.

17. The tape dispensing device for dispensing a tape according to claim 4, wherein said actuator includes, a first rotatable body operatively coupled to a said first tape holder slider;

a second rotatable body operatively coupled to said second tape holder slider; and a third rotatable body operatively coupled to said third tape holder slider.

* * * * *